US011326819B2

(12) United States Patent
Iwata et al.

(10) Patent No.: US 11,326,819 B2
(45) Date of Patent: May 10, 2022

(54) REFRIGERATION APPARATUS

(71) Applicant: DAIKIN INDUSTRIES, LTD., Osaka (JP)

(72) Inventors: Ikuhiro Iwata, Osaka (JP); Kazuhiro Furusho, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 49 days.

(21) Appl. No.: 16/481,684

(22) PCT Filed: Jan. 26, 2018

(86) PCT No.: PCT/JP2018/002515
§ 371 (c)(1),
(2) Date: Jul. 29, 2019

(87) PCT Pub. No.: WO2018/139589
PCT Pub. Date: Aug. 2, 2018

(65) Prior Publication Data

US 2019/0376731 A1 Dec. 12, 2019

(30) Foreign Application Priority Data

Jan. 30, 2017 (JP) ..... JP2017-014091

(51) Int. Cl.
*F25B 45/00* (2006.01)
*F25B 49/02* (2006.01)

(52) U.S. Cl.
CPC ..... *F25B 45/00* (2013.01); *F25B 49/02* (2013.01); *F25B 2400/12* (2013.01);
(Continued)

(58) Field of Classification Search
CPC ..... F25B 2500/07; F25B 2500/08; F25B 2600/2523; F25B 2600/2525; F25B 2400/16; F25B 2400/051; F25B 2400/053
See application file for complete search history.

(56) References Cited

U.S. PATENT DOCUMENTS 4,841,739 A * 6/1989 Wallner ..... B60H 1/00585 62/174
10,018,393 B2 * 7/2018 Kopko ..... F25B 49/025
(Continued)

FOREIGN PATENT DOCUMENTS

DE 3721388 C1 12/1988
JP S6419269 A 1/1989
(Continued)

OTHER PUBLICATIONS

Environmental protection Agency, Complying with the section 608 Refrigerant Recycling Rule, 2006 (Year: 2006).*
(Continued)

*Primary Examiner* — Jonathan Bradford
(74) *Attorney, Agent, or Firm* — Osha Bergman Watanabe & Burton LLP

(57) ABSTRACT

A refrigeration apparatus includes a refrigerant circuit including: a compressor, a radiator, an expansion mechanism, and an evaporator. The refrigerant circuit encloses a refrigerant that contains a fluorinated hydrocarbon that causes a disproportionation reaction. The refrigerant circuit further includes: a discharged refrigerant recovery receiver that is connected to a path between a discharge side of the compressor and a gas side of the radiator through a discharged refrigerant branch pipe; and a discharged refrigerant relief mechanism that is disposed in the discharged refrigerant branch pipe and that connects the discharge side of the compressor with the discharged refrigerant recovery receiver when the refrigerant on the discharge side of the compressor satisfies a predetermined condition. The predetermined condition includes at least one of a first condition under which the refrigerant does not yet cause the disproportionation reaction and a second condition under which the refrigerant causes the disproportionation reaction.

9 Claims, 20 Drawing Sheets

(52) U.S. Cl.
CPC ..... *F25B 2400/16* (2013.01); *F25B 2500/06* (2013.01); *F25B 2600/2523* (2013.01); *F25B 2700/1931* (2013.01); *F25B 2700/21152* (2013.01)

(56) References Cited

U.S. PATENT DOCUMENTS

| | | | | |
|---|---|---|---|---|
| 2005/0132729 | A1* | 6/2005 | Manole | F25B 1/10 62/149 |
| 2011/0041523 | A1 | 2/2011 | Taras et al. | |
| 2014/0070132 | A1 | 3/2014 | Fukushima | |
| 2015/0300701 | A1 | 10/2015 | Nakaguchi et al. | |
| 2017/0138645 | A1* | 5/2017 | Sakima | F25B 41/20 |

FOREIGN PATENT DOCUMENTS

| | | | | |
|---|---|---|---|---|
| JP | 2005153711 | A | 6/2005 | |
| JP | 2015206553 | A | 11/2015 | |
| JP | 2015218909 | A | 12/2015 | |
| WO | 2012157764 | A1 | 11/2012 | |
| WO | 2015140876 | A1 | 9/2015 | |
| WO | 2015140882 | A1 | 9/2015 | |
| WO | WO-2015140876 | A1 * | 9/2015 | F25B 49/02 |
| WO | WO-2015140882 | A1 * | 9/2015 | F25B 49/02 |
| WO | 2015174054 | A1 | 11/2015 | |

OTHER PUBLICATIONS

Translation of Arii (Year: 2015).*
Translation of Ugajin (Year: 2015).*
Extended European Search Report issued in the counterpart European Patent Application No. 18744977.2, dated Oct. 30, 2020 (7 pages).
International Search Report issued in corresponding International Application No. PCT/JP2018/002515, dated Apr. 10, 2018, with translation (4 pages).
Written Opinion issued in corresponding International Application No. PCT/JP2018/002515, dated Apr. 10, 2018 (6 pages).
English Translation of the International Preliminary Report on Patentability issued in International Application No. PCT/JP2018/002515, dated Aug. 8, 2019 (10 pages).

* cited by examiner

REFRIGERATION APPARATUS

TECHNICAL FIELD

The present invention relates to a refrigeration apparatus.

BACKGROUND

For the purpose of preventing destruction of the ozone layer, HFC-32 (difluoromethane), HFC-410A that is a mixture of HFC-32 and HFC-125 (pentafluoroethane), and the like have hitherto been used as refrigerants enclosed in a refrigerant circuit of a refrigeration apparatus. However, those refrigerants have a large GWP (Global Warming Potential).

Meanwhile, it is known that a refrigerant containing HFO-1123 (1,1,2-trifluoroethylene), described in Patent Literature 1 (International Publication No. 2012/157764) causes less impacts on the ozone layer and the global warming. Patent Literature 1 describes a refrigeration apparatus that is constituted by enclosing the above refrigerant in a refrigerant circuit.

However, the refrigerant described in Patent Literature 1 has nature causing a disproportionation reaction (self-decomposition reaction) when some energy is applied to the refrigerant under conditions of high pressure and high temperature. If the refrigerant causes the disproportionation reaction in the refrigerant circuit, there is a risk that an abrupt pressure rise and an abrupt temperature rise may be generated, whereby devices or pipes constituting the refrigerant circuit may be damaged and the refrigerant or reaction products may be released to the outside of the refrigerant circuit. In particular, because the refrigerant discharged from a compressor is in a state of high pressure and high temperature, it may cause the disproportionation reaction with a high probability.

PATENT LITERATURE

<Patent Literature 1> International Publication No. 2012/157764

SUMMARY

One or more embodiments of the present invention, in a refrigeration apparatus that has a refrigerant circuit in which a refrigerant containing a fluorinated hydrocarbon of nature tending to cause the disproportionation reaction is enclosed, reduces damage of the refrigerant circuit when the refrigerant causes the disproportionation reaction or inhibits the refrigerant from causing the disproportionation reaction.

A refrigeration apparatus according to one or more embodiments includes a refrigerant circuit constituted by connecting a compressor, a radiator, an expansion mechanism, and an evaporator. The refrigerant circuit includes a refrigerant that is enclosed therein and that contains a fluorinated hydrocarbon of nature tending to cause a disproportionation reaction. The refrigerant circuit further includes a discharged refrigerant recovery receiver and a discharged refrigerant relief mechanism. The discharged refrigerant recovery receiver is branch-connected to a path between the discharge side of the compressor and the gas side of the radiator through a discharged refrigerant branch pipe. The discharged refrigerant relief mechanism is disposed in the discharged refrigerant branch pipe and makes the discharge side of the compressor and the discharged refrigerant recovery receiver communicated with each other when the refrigerant on the discharge side of the compressor satisfies a predetermined condition under which the refrigerant causes a disproportionation reaction or does not yet cause the disproportionation reaction.

A region of the refrigerant circuit where the refrigerant is apt to cause the disproportionation reaction is a region on the discharge side of the compressor where the refrigerant comes into a state of maximum pressure and maximum temperature. In order to minimize the damage of the refrigerant circuit when the refrigerant has caused the disproportionation reaction, an abrupt pressure rise and an abrupt temperature rise generated with the disproportionation reaction has to be suppressed. Furthermore, in order to inhibit the refrigerant from causing the disproportionation reaction, the pressure and the temperature of the refrigerant need to be made harder to reach conditions of the pressure and the temperature under which the refrigerant causes the disproportionation reaction.

From that point of view, here, the discharged refrigerant recovery receiver is branch-connected to the path between the discharge side of the compressor and the gas side of the radiator through the discharged refrigerant relief mechanism, and the refrigerant on the discharge side of the compressor is recovered to the discharged refrigerant recovery receiver by making the discharge side of the compressor and the discharged refrigerant recovery receiver communicated with each other when the refrigerant on the discharge side of the compressor satisfies the predetermined condition. Here, when the predetermined condition is a condition under which the refrigerant on the discharge side of the compressor causes the disproportionation reaction, the abrupt pressure rise and the abrupt temperature rise generated with the disproportionation reaction can be suppressed by recovering the refrigerant on the discharge side of the compressor to the discharged refrigerant recovery receiver. When the predetermined condition is a condition under which the refrigerant on the discharge side of the compressor does not yet cause the disproportionation reaction, the pressure and the temperature of the refrigerant can be made harder to reach the conditions of the pressure and the temperature under which the refrigerant causes the disproportionation reaction.

As a result, here, it is possible to reduce the damage of the refrigerant circuit in the event of the refrigerant causing the disproportionation reaction, or to inhibit the refrigerant from causing the disproportionation reaction.

Just from the viewpoint of suppressing the abrupt pressure rise and the abrupt temperature rise, it is conceivable to branch-connect only the discharged refrigerant relief mechanism to the path between the discharge side of the compressor and the gas side of the radiator through the discharged refrigerant branch pipe. However, the refrigerant and reaction products cannot be recovered, and they are released to the outside of the refrigerant circuit. It is also conceivable to dispose a muffler between the discharge side of the compressor and the gas side of the radiator. However, the muffler is brought into a state always filled with the refrigerant discharged from the compressor, and hence the action of suppressing the rise of the pressure and temperature is limited. Thus, with the provision of only the muffler, the damage of the refrigerant circuit in the event of the refrigerant causing the disproportionation reaction cannot be reduced, or the refrigerant cannot be kept from causing the disproportionation reaction. In summary, it is important to branch connect the discharged refrigerant recovery receiver to the path between the discharge side of the compressor and the gas side of the radiator through the discharged refrigerant relief mechanism.

A refrigeration apparatus according to one or more embodiments, further includes a cooling mechanism cooling the discharged refrigerant recovery receiver.

With the cooling mechanism described above, the refrigerant recovered to the discharged refrigerant recovery receiver can be cooled. A recovery performance during recovering the refrigerant on the discharge side of the compressor to the discharged refrigerant recovery receiver can therefore be increased. Thus, when the predetermined condition is the condition under which the refrigerant on the discharge side of the compressor causes the disproportionation reaction, the abrupt pressure rise and the abrupt temperature rise generated with the disproportionation reaction can be further suppressed. When the predetermined condition is the condition under which the refrigerant on the discharge side of the compressor dose not yet cause the disproportionation reaction, the pressure and the temperature of the refrigerant can be made harder to reach the conditions of the pressure and the temperature under which the refrigerant causes the disproportionation reaction.

As a result, here, it is possible to further reduce the damage of the refrigerant circuit in the event of the refrigerant causing the disproportionation reaction, or to inhibit the refrigerant from causing the disproportionation reaction more reliably.

According to the refrigeration apparatus of one or more embodiments, the cooling mechanism is a fan delivering air to the discharged refrigerant recovery receiver.

With the feature described above, the discharged refrigerant recovery receiver can be cooled with the aid of the fan delivering air to the discharged refrigerant recovery receiver.

According to the refrigeration apparatus of one or more embodiments, the fan delivers the air to the radiator or the evaporator as well.

With the feature described above, the fan delivering air to the discharged refrigerant recovery receiver can also be used as a fan delivering the air to the radiator or the evaporator as well. Such a configuration is preferable when the refrigeration apparatus is of the air-cooled type.

According to the refrigeration apparatus of one or more embodiments, the cooling mechanism is a radiating fin disposed on an outer surface of the discharged refrigerant recovery receiver.

With the feature described above, the discharged refrigerant recovery receiver can be cooled with the aid of the radiating fin disposed on the outer surface of the discharged refrigerant recovery receiver. Such a configuration is preferable when the fan is used as the cooling mechanism in a combined manner.

According to the refrigeration apparatus of one or more embodiments, the cooling mechanism is a cooling liquid pipe through which a cooling liquid flows and which is disposed to the discharged refrigerant recovery receiver.

With the feature described above, the discharged refrigerant recovery receiver can be cooled with the aid of the cooling liquid pipe through which the cooling liquid flows.

According to the refrigeration apparatus of one or more embodiments, the evaporator is a heat exchanger in which the refrigerant is evaporated with the cooling liquid, and the cooling liquid cooled by evaporation of the refrigerant in the evaporator flows through the cooling liquid pipe.

With the feature described above, since the cooling liquid having been cooled by evaporation of the refrigerant in the evaporator flows through the cooling liquid pipe, the effect of cooling the discharged refrigerant recovery receiver can be increased. Such a configuration is preferable when the refrigeration apparatus is of the water-cooled type or the secondary refrigerant type.

According to the refrigeration apparatus of one or more embodiments, the discharged refrigerant relief mechanism is a relief valve that operates when primary-side pressure is higher than or equal to a specified pressure, and the specified pressure is a threshold pressure corresponding to the predetermined condition.

With the features described above, the relief valve operating when the primary-side pressure is higher than or equal to the specified pressure, e.g., a mechanical valve mechanism such as a spring relief valve or a rupture disk, is used as the discharged refrigerant relief mechanism. Accordingly, by setting the specified pressure to the threshold pressure corresponding to the predetermined condition under which the refrigerant on the discharge side of the compressor causes the disproportionation reaction or does not yet cause the disproportionation reaction, it is possible to make the discharge side of the compressor and the discharged refrigerant recovery receiver communicated with each other, and to reduce the damage of the refrigerant circuit in the event of the refrigerant causing the disproportionation reaction or to inhibit the refrigerant from causing the disproportionation reaction.

According to the refrigeration apparatus of one or more embodiments, the discharged refrigerant relief mechanism is a fusible plug in which a fusible material fuses when atmosphere temperature is higher than or equal to a specified temperature, and the specified temperature is a threshold temperature corresponding to the predetermined condition.

With the features described above, the fusible plug in which the fusible material fuses when the atmosphere temperature is higher than or equal to the specified temperature is used as the discharged refrigerant relief mechanism. Accordingly, by setting the specified temperature to the threshold temperature corresponding to the predetermined condition under which the refrigerant on the discharge side of the compressor causes the disproportionation reaction or does not yet cause the disproportionation reaction, it is possible to make the discharge side of the compressor and the discharged refrigerant recovery receiver communicated with each other, and to reduce the damage of the refrigerant circuit in the event of the refrigerant causing the disproportionation reaction or to inhibit the refrigerant from causing the disproportionation reaction.

A refrigeration apparatus according to one or more embodiments further includes a control unit controlling operation of the refrigerant circuit, and a discharged refrigerant sensor detecting pressure and temperature of the refrigerant on the discharge side of the compressor. The discharged refrigerant relief mechanism is a first control valve of which an open/closed state is controlled by the control unit, and the control unit determines, based on the pressure and the temperature of the refrigerant detected by the discharged refrigerant sensor, whether the predetermined condition is satisfied, and controls the first control valve to be shifted from the closed state to the open state when the predetermined condition is satisfied.

With the features described above, the first control valve of which an open/closed state is controlled by the control unit, e.g., an electric valve mechanism such as an electromagnetic valve or an electrically powered valve, is used as the discharged refrigerant relief mechanism. Accordingly, by determining, based on the pressure and the temperature of the refrigerant detected by the discharged refrigerant sensors, whether the predetermined condition under which the refrigerant on the discharge side of the compressor causes the disproportionation reaction or does not yet cause the disproportionation reaction is satisfied, the control unit can make the discharge side of the compressor and the discharged refrigerant recovery receiver communicated with each other, and can reduce the damage of the refrigerant circuit in the event of the refrigerant causing the disproportionation reaction or inhibit the refrigerant from causing the disproportionation reaction.

According to the refrigeration apparatus of one or more embodiments, the control unit determines that the predetermined condition is satisfied, when a multiplication value of the pressure and the temperature of the refrigerant detected by the discharged refrigerant sensor is higher than or equal to a threshold multiplication value at which the refrigerant causes the disproportionation reaction or does not yet cause the disproportionation reaction.

A relation between the pressure and the temperature at which the refrigerant causes the disproportionation reaction is a substantially inverse relation. In other words, the pressure and the temperature have such a relation that the disproportionation reaction is caused when a multiplication value of the pressure and the temperature of the refrigerant is higher than or equal to a certain value.

Therefore, here, as described above, the determination as to whether the predetermined condition is satisfied is made by determining whether the multiplication value of the pressure and the temperature of the refrigerant on the discharge side of the compressor is higher than or equal to the threshold multiplication value at which the refrigerant causes the disproportionation reaction or does not yet cause the disproportionation reaction.

As a result, here, whether the predetermined condition is satisfied can be appropriately determined by using the multiplication value of the pressure and the temperature of the refrigerant on the discharge side of the compressor.

According to the refrigeration apparatus of one or more embodiments, the control unit determines that the predetermined condition is satisfied, when the temperature of the refrigerant detected by the discharged refrigerant sensor is higher than or equal to a threshold temperature at which the refrigerant causes the disproportionation reaction or does not yet cause the disproportionation reaction at a maximum operating pressure of the refrigerant circuit.

From the viewpoint of strength design for the refrigerant circuit, it should be determined whether the refrigerant on the discharge side of the compressor satisfies the predetermined condition causing the disproportionation reaction or not yet causing the disproportionation reaction in consideration of a maximum operating pressure of the refrigerant circuit.

Thus, here, the determination as to whether the predetermined condition is satisfied is made by determining whether the temperature of the refrigerant on the discharge side of the compressor is higher than or equal to the threshold temperature at which the refrigerant causes the disproportionation reaction or does not yet cause the disproportionation reaction at the maximum operating pressure of the refrigerant circuit.

As a result, here, whether the predetermined condition is satisfied can be appropriately determined in accordance with the temperature on the discharge side of the compressor at the maximum operating pressure of the refrigerant circuit.

According to the refrigeration apparatus of one or more embodiments, the refrigerant circuit further includes a refrigerant suction return pipe and a second control valve. The refrigerant suction return pipe connects the discharged refrigerant recovery receiver and the suction side of the compressor. The second control valve is disposed in the refrigerant suction return pipe, and an open/closed state of the second control valve is controlled by the control unit. The predetermined condition includes a first condition under which the refrigerant does not yet cause the disproportionation reaction and a second condition under which the refrigerant causes the disproportionation reaction. The control unit determines, based on the pressure and the temperature of the refrigerant detected by the discharged refrigerant sensor, whether the first condition is satisfied, and controls the first control valve to be in the open state and the second control valve to be in the open state when the first condition is satisfied.

With the features described above, the discharged refrigerant recovery receiver and the suction side of the compressor are connected through the second control valve, and the second control valve is also set to the open state in addition to the first control valve when the first condition under which the refrigerant does not yet cause the disproportionation reaction is satisfied. Therefore, the refrigerant on the discharge side of the compressor can be temporarily recovered into the discharged refrigerant recovery receiver, and the pressure and the temperature of the refrigerant can be made harder to reach the conditions of the pressure and the temperature under which the refrigerant causes the disproportionation reaction.

As a result, here, the operation can be continued while the refrigerant is inhibited from causing the disproportionation reaction.

According to the refrigeration apparatus of one or more embodiments, the control unit determines, based on the pressure and the temperature of the refrigerant detected by the discharged refrigerant sensor, whether the second condition is satisfied, and controls the first control valve to be in the open state and the second control valve to be in the closed state when the second condition is satisfied.

With the features described above, when the second condition under which the refrigerant causes the disproportionation reaction is satisfied, the first control valve is to be in the open state and the second control valve is to be in the closed state. Therefore, the refrigerant on the discharge side of the compressor can be recovered and accumulated in the discharged refrigerant recovery receiver, and the abrupt pressure rise and the abrupt temperature rise generated with the disproportionation reaction can be suppressed.

As a result, here, the operation can be safely stopped while the damage of the refrigerant circuit in the event of the refrigerant causing the disproportionation reaction is reduced.

According to the refrigeration apparatus of one or more embodiments, the refrigerant contains HFO-1123.

HFO-1123 is one type of fluorinated hydrocarbon of nature causing the disproportionation reaction, and has properties close to those of HFC-32 and HFC-410A in boiling point, etc. Therefore, the refrigerant containing HFO-1123 can be used as an alternative to HFC-32 and HFC-410A.

Thus, this refrigeration apparatus uses the refrigerant containing HFO-1123 as an alternative to HFC-32 and HFC-410A, and can reduce the damage of the refrigerant circuit in the event of the refrigerant causing the disproportionation reaction, or can inhibit the refrigerant from causing the disproportionation reaction.

DETAILED DESCRIPTION

Embodiments of a refrigeration apparatus according to the present invention will be described below with reference to the drawings. It is to be noted that specific configurations of the refrigeration apparatus according to the present invention are not limited to the following embodiments and modifications, and that they can be modified within the scope not departing from the gist of the present invention.

(1) Basic Configuration

Figure 1:
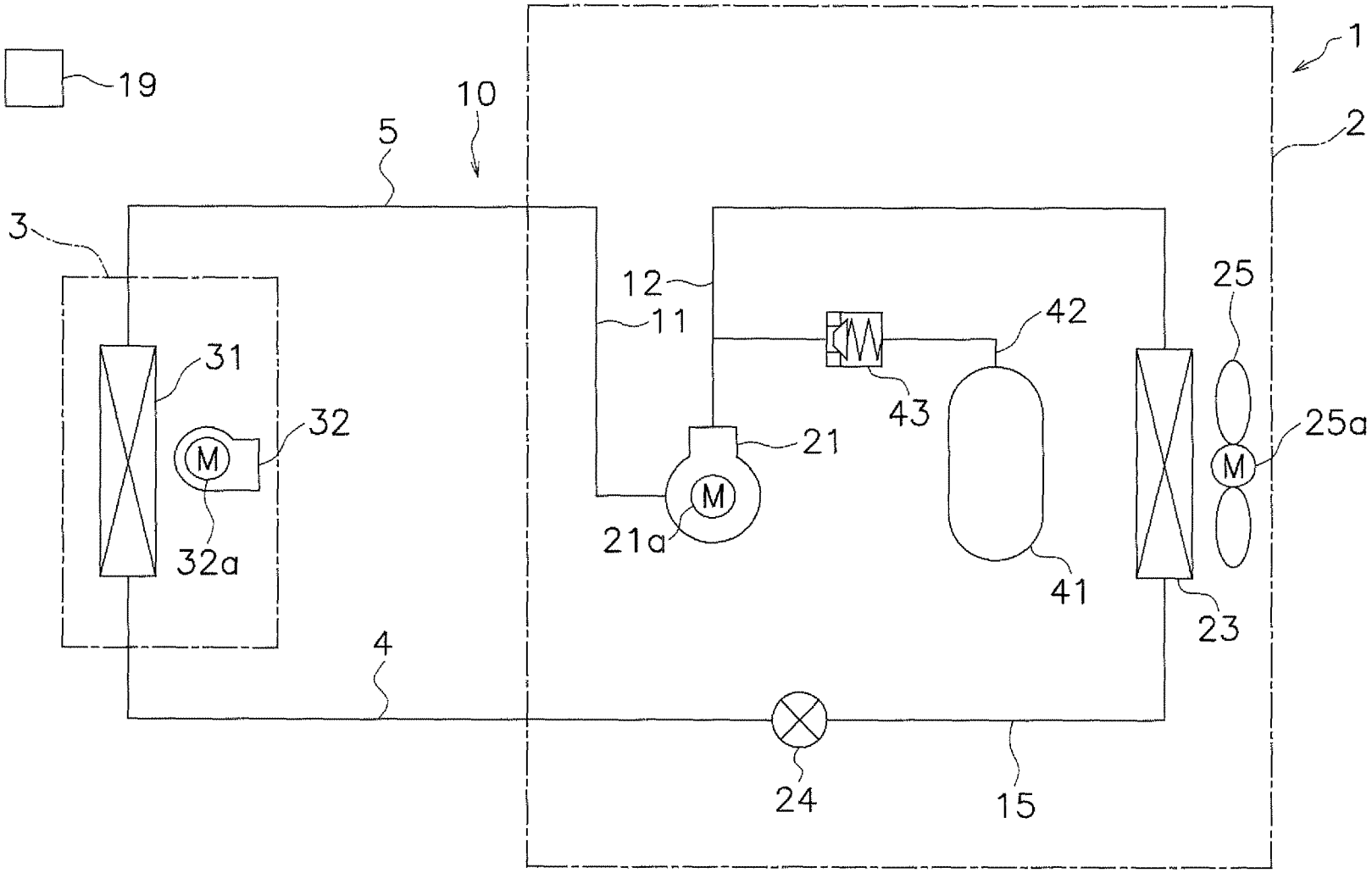
FIG. 1 is a schematic diagram of an air conditioner as one of a refrigeration apparatus according to one or more embodiments of the present invention.

FIG. 1 is a schematic diagram of an air conditioner 1 as one of a refrigeration apparatus according to one or more embodiments of the present invention.

<Overall Configuration>

The air conditioner 1 is an apparatus capable of cooling and heating the indoor, such as the inside of buildings, by carrying out a vapor compression refrigeration cycle. The air conditioner 1 mainly includes an outdoor unit 2, an indoor unit 3, a liquid-refrigerant connection pipe 4 and a gas-refrigerant connection pipe 5 each connecting the outdoor unit 2 and the indoor unit 3, and a control unit 19 controlling components of the outdoor unit 2 and the indoor unit 3. A vapor compression refrigerant circuit 10 of the air conditioner 1 is constituted by connecting the outdoor unit 2 and the indoor unit 3 through the refrigerant connection pipes 4 and 5.

<Indoor Unit>

The indoor unit 3 is installed in a room or a ceiling space and constitutes part of the refrigerant circuit 10. The indoor unit 3 mainly includes an indoor heat exchanger 31 as a second heat exchanger, and an indoor fan 32.

The indoor heat exchanger 31 is a heat exchanger that performs heat exchange between indoor air and a refrigerant which is transferred to and from the outdoor unit 2 through the liquid-refrigerant connection pipe 4 and the gas-refrigerant connection pipe 5. The liquid side of the indoor heat exchanger 31 is connected to the liquid-refrigerant connection pipe 4, and the gas side of the indoor heat exchanger 31 is connected to the gas-refrigerant connection pipe 5.

The indoor fan 32 is a fan for delivering the indoor air to the indoor heat exchanger 31. The indoor fan 32 is driven by an indoor fan motor 32*a*.

<Outdoor Unit>

The outdoor unit 2 is installed outdoors and constitutes part of the refrigerant circuit 10. The outdoor unit 2 mainly includes a compressor 21, an outdoor heat exchanger 23 serving as a radiator, an expansion valve 24 serving as an expansion mechanism, and an outdoor fan 25.

The compressor 21 is an apparatus for compressing the refrigerant. For example, as the compressor 21, a compressor in which a displacement-type compression element (not illustrated) is driven and rotated by a compressor motor 21*a*. An intake pipe 11 is connected to the suction side of the compressor 21, and a discharge pipe 12 is connected to the discharge side of the compressor 21. The intake pipe 11 is connected to the gas-refrigerant connection pipe 5.

The outdoor heat exchanger 23 is a heat exchanger that performs heat exchange between outdoor air and the refrigerant which is transferred to and from the indoor unit 3 through the liquid-refrigerant connection pipe 4 and the gas-refrigerant connection pipe 5. The liquid side of the outdoor heat exchanger 23 is connected to a liquid refrigerant pipe 15, and the gas side of the outdoor heat exchanger 23 is connected to the discharge pipe 12. The liquid refrigerant pipe 15 is connected to the liquid-refrigerant connection pipe 4.

The expansion valve 24 is an electrically powered valve for decompressing the refrigerant and is disposed in the liquid refrigerant pipe 15. An expansion mechanism is not limited to the expansion valve 24, and a capillary tube or an expander may be used as the expansion mechanism instead of the expansion valve 24.

The outdoor fan 25 is a fan for delivering the outdoor air to the outdoor heat exchanger 23. The outdoor fan 25 is driven by an outdoor fan motor 25*a*.

<Refrigerant Connection Pipe>

The refrigerant connection pipes 4 and 5 are refrigerant pipes that are connected on site when the air conditioner 1 is installed at an installation location in a building, etc.

<Control Unit>

The control unit 19 is constituted by connecting control boards, etc. (not illustrated), which are disposed in the outdoor unit 2 and the indoor unit 3, via communication. In FIG. 1, for the sake of convenience, the control unit 19 is illustrated at a position away from the outdoor unit 2 and the indoor unit 3. The control unit 19 controls the devices 21, 24, 25, 31, and 32 constituting the air conditioner 1 (i.e., the outdoor unit 2 and the indoor unit 3). In other words, the control unit 19 controls the operation of the entirety of the air conditioner 1.

<Refrigerant Enclosed in Refrigerant Circuit>

A refrigerant containing a fluorinated hydrocarbon of nature tending to cause the disproportionation reaction is enclosed in the refrigerant circuit 10. As such a refrigerant, there is an ethylene-based fluorinated hydrocarbon (hydrofluoroolefin) that has little impact on both the ozone layer and the global warming and has a carbon-carbon double bond, which can easily be decomposed by OH radicals. In one or more embodiments, a refrigerant containing, as one type of hydrofluoroolefin (HFO), HFO-1123 having properties close to those of HFC-32 and HFC-410A in boiling point, etc. and exhibiting high performance is used. Thus, the refrigerant containing HFO-1123 can be used as an alternative to HFC-32 and HFC-410A.

For example, HFO-1123 alone or a mixture of HFO-1123 and another refrigerant/other refrigerants may be used as the refrigerant containing HFO-1123. An example of the mixture of HFO-1123 and another refrigerant is a mixture of HFO-1123 and HFC-32. A composition ratio (wt %) between HFO-1123 and HFC-32 is 40:60. Another example is a mixture of HFO-1123, HFC-32, and HFO-1234yf (2,3,3,3-tetrafluoropropene). A composition ratio (wt %) among HFO-1123, HFC-32, and HFO-1234yf is 40:44:16.

The above-mentioned refrigerants containing HFO-1123 are each mixed with HFC-32, which is one type of HFC, as a component for improving the performance, but the carbon number of the added HFC is preferably not more than 5 from the viewpoint of minimizing the impact on the ozone layer and the global warming. Specific examples of such HFC include, in addition to HFC-32, difluoroethane, trifluoroethane, tetrafluoroethane, HFC-125, pentafluoropropane, hexafluoropropane, heptafluoropropane, pentafluorobutane, and heptafluorobutane. Among those examples, HFC-32, 1,1-difluoroethane (HFC-152a), 1,1,2,2-tetrafluoroethane (HFC-134), and 1,1,1,2-tetrafluoroethane (HFC-134a) are known as being able to reduce the impact on both the ozone layer and the global warming. In a mixture with HFO-1123, only one type or two or more types among the above examples of HFC may be added. Hydrochlorofluoroolefin (HCFO) containing halogen at a higher proportion in molecules and having lower flammability may be mixed with HFO-1123. Specific examples of HCFO includes 1-chloro-2,3,3,3-tetrafluoropropene (HCFO-1224yd), 1-chloro-2,2-difluoroethylene (HCFO-1122), 1,2-dichlorofluoroethylene (HCFO-1121), 1-chloro-2-fluoroethylene (HCFO-1131), 2-chloro-3,3,3-trifluoropropene (HCFO-1233xf), and 1-chloro-3,3,3-trifluoropropene (HCFO-1233zd). Among the above examples, HCFO-1224yd is known as having high performance, and HCFO-1233zd is known as having high critical temperature and being superior in durability and coefficient of performance. In a mixture with HFO-1123, only one type or two or more types among the above examples of HCFO and HCFC may be added. Other types of hydrocarbon, CFO, etc. may also be used as the refrigerant mixed into HFO-1123.

The fluorinated hydrocarbon of nature tending to cause the disproportionation reaction is not limited to HFO-1123 and it may be another type of HFO. For example, among 3,3,3-trifluoropropene (HFO-1243zf), 1,3,3,3-tetrafluoropropene (HFO-1234ze), 2-fluoropropene (HFO-1261yf), HFO-1234yf, 1,1,2-trifluoropropene (HFO-1243yc), 1,2,3,3,3-pentafluoropropene (HFO-1225ye), trans-1,3,3,3-tetrafluoropropene (HFO-1234ze(E)), and cis-1,3,3,3-tetrafluoropropene (HFO-1234ze(Z)), the ethylene-based fluorinated hydrocarbon of nature tending to cause the disproportionation reaction may be used. Furthermore, instead of the ethylene-based fluorinated hydrocarbon having the carbon-carbon double bond, an acetylene-based fluorinated hydrocarbon having a carbon-carbon triple bond and being of nature tending to cause the disproportionation reaction may be used as the fluorinated hydrocarbon of nature tending to cause the disproportionation reaction.

(2) Basic Operation

The air conditioner 1 performs a cooling operation as a basic operation. The cooling operation is carried out by the control unit 19.

During the cooling operation, in the refrigerant circuit 10, a gas refrigerant at low pressure in the refrigeration cycle is sucked into the compressor 21 and is discharged after being compressed to high pressure in the refrigeration cycle. The gas refrigerant at high pressure discharged from the compressor 21 is delivered to the outdoor heat exchanger 23. The high-pressure gas refrigerant delivered to the outdoor heat exchanger 23 radiates heat through heat exchange with the outdoor air, which is supplied as a cooling source by the outdoor fan 25, in the outdoor heat exchanger 23 and becomes a high-pressure liquid refrigerant. The high-pressure liquid refrigerant after radiating heat in the outdoor heat exchanger 23 is delivered to the expansion valve 24. The high-pressure liquid refrigerant delivered to the expansion valve 24 is decompressed by the expansion valve 24 to the low pressure in the refrigeration cycle and becomes a low-pressure refrigerant in a gas-liquid two-phase state. The low-pressure refrigerant in the gas-liquid two-phase state decompressed by the expansion valve 24 is delivered to the indoor heat exchanger 31 through the liquid-refrigerant connection pipe 4. The low-pressure refrigerant in the gas-liquid two-phase state, which has been delivered to the indoor heat exchanger 31, evaporates in the indoor heat exchanger 31 through heat exchange with the indoor air that is supplied as a heating source by the indoor fan 32. Thus, the indoor air is cooled and then supplied to the inside of a room for cooling the room. The low-pressure gas refrigerant after having been evaporated in the indoor heat exchanger 31 is sucked into the compressor 21 again through the gas-refrigerant connection pipe 5.

(3) Measures Against Disproportionation Reaction of Refrigerant (Circuit Configuration for Recovery of Discharged Refrigerant)

Figure 2:
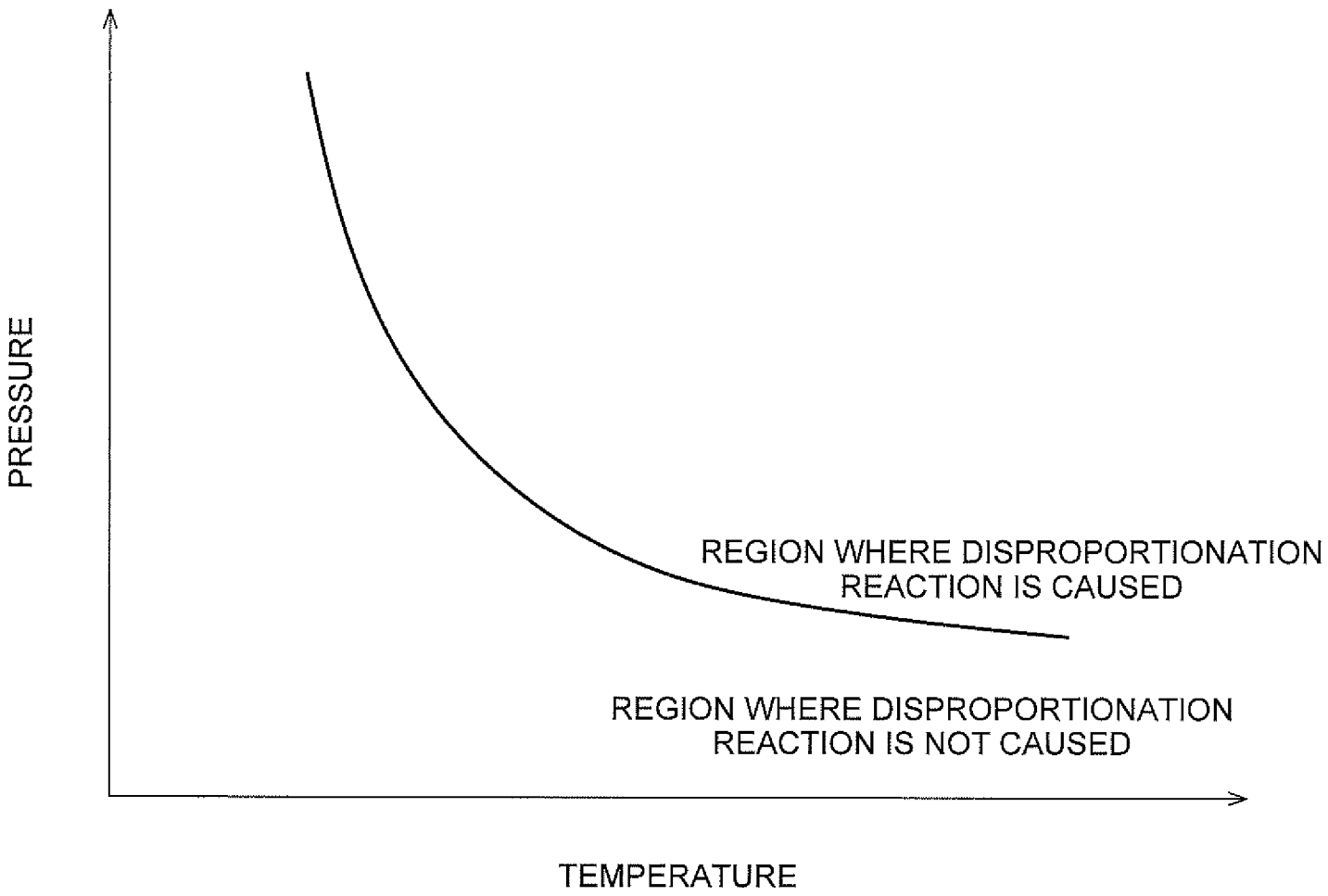
FIG. 2 is a graph depicting a relation between pressure and temperature at which a refrigerant causes a disproportionation reaction according to one or more embodiments.

There is a risk that the refrigerant containing the fluorinated hydrocarbon of nature tending to cause the disproportionation reaction may cause the disproportionation reaction when some energy is applied to the refrigerant under conditions of high pressure and high temperature. FIG. 2 is a graph depicting a relation between pressure and temperature at which the refrigerant causes the disproportionation reaction according to one or more embodiments. A curve in FIG. 2 indicates boundaries of the pressure and the temperature at which the refrigerant causes the disproportionation reaction. The refrigerant causes the disproportionation reaction in a region on and above the curve and does not cause the disproportionation reaction in a region below the curve. When the pressure and the temperature of the refrigerant rise in the refrigerant circuit 10 and reach the region on or above the curve in FIG. 2, where the refrigerant causes the disproportionation reaction, there is a risk that the refrigerant causes the disproportionation reaction and the pressure and the temperature abruptly rise in the refrigerant circuit 10, and thereby, the devices or pipes constituting the refrigerant circuit 10 may be damaged and the refrigerant or reaction products may be released to the outside of the refrigerant circuit 10.

In particular, a region of the refrigerant circuit 10 where the refrigerant is apt to cause the disproportionation reaction is a region on the discharge side of the compressor 21 where the refrigerant comes into a state of the highest pressure and the highest temperature. In order to minimize the damage of the refrigerant circuit 10 when the refrigerant has caused the disproportionation reaction, an abrupt pressure rise and an abrupt temperature rise generated with the disproportionation reaction should be suppressed.

Thus, in one or more embodiments, as described below, a discharged refrigerant recovery receiver is branch-connected to a path between the discharge side of the compressor 21 and the gas side of the radiator through a discharged refrigerant relief mechanism, and the discharge side of the compressor 21 and the discharged refrigerant recovery receiver are communicated with each other when the refrigerant on the discharge side of the compressor 21 satisfies a predetermined condition.

<Circuit Configuration for Recovery of Discharged Refrigerant>

The refrigerant circuit 10 further includes a discharged refrigerant recovery receiver 41 and a relief valve 43 serving as the discharged refrigerant relief mechanism.

The discharged refrigerant recovery receiver 41 is branch-connected to a path (here, a discharge pipe 12) between the discharge side of the compressor 21 and the gas side of the outdoor heat exchanger 23 serving as the radiator, through the discharged refrigerant branch pipe 42.

Figure 3:
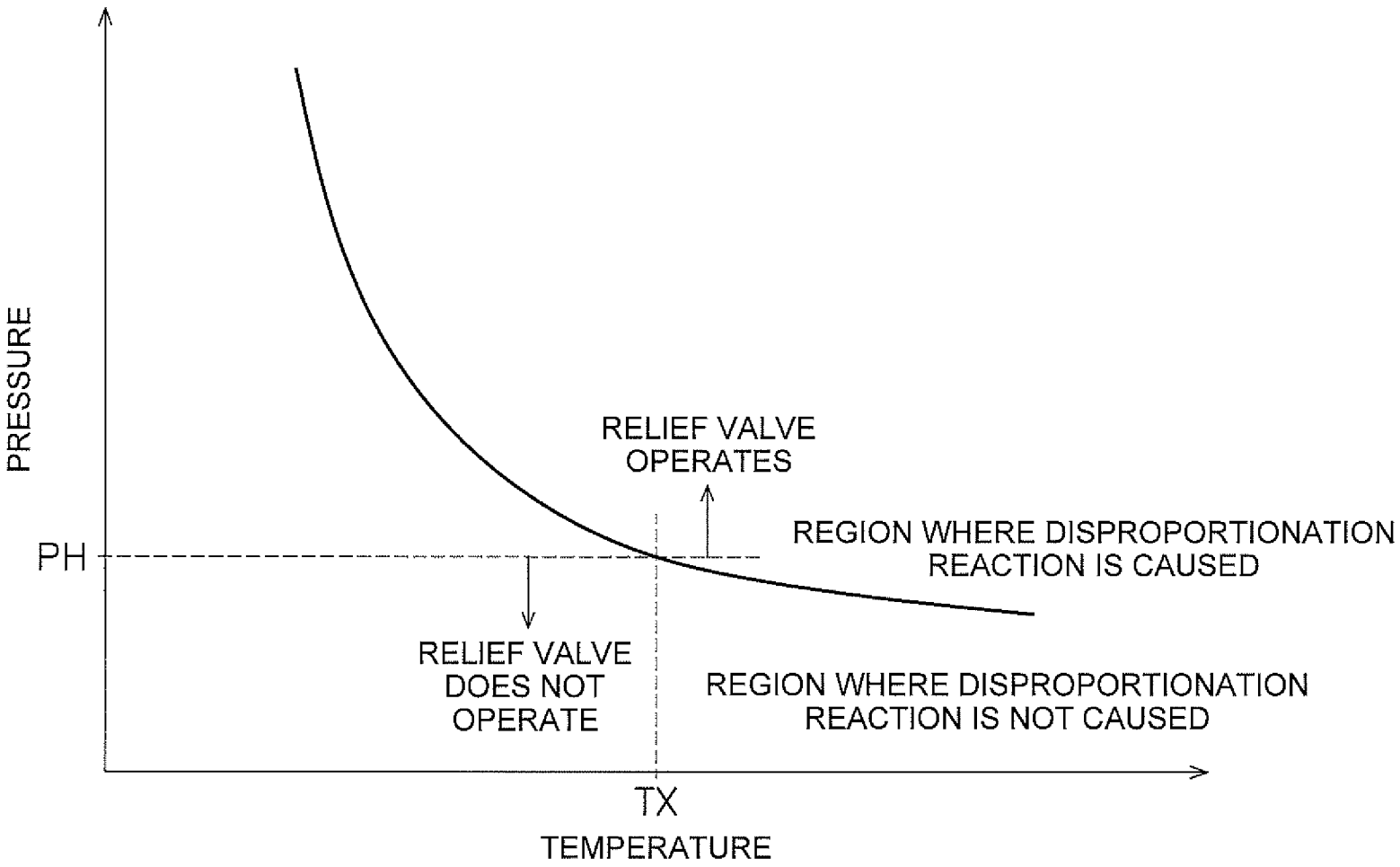
FIG. 3 is a graph depicting, when a relief valve is used as a discharged refrigerant relief mechanism, a specified pressure (threshold pressure) of the relief valve, which represents a predetermined condition causing the disproportionation reaction according to one or more embodiments.

The relief valve 43 is disposed in the discharged refrigerant branch pipe 42 to make the discharge side of the compressor 21 and the discharged refrigerant recovery receiver 41 communicated with each other when the refrigerant on the discharge side of the compressor 21 satisfies a predetermined condition. Here, the relief valve 43 is a valve mechanism that operates when the pressure on the primary side (here, the discharge side of the compressor 21) is higher than or equal to a specified pressure. For example, a mechanical valve mechanism, such as a spring-type relief valve or a rupture disk, is used as the relief valve 43. The specified pressure of the relief valve 43 is set here to a threshold pressure PH corresponding to a predetermined condition (second condition) causing the disproportionation reaction. As illustrated in FIG. 3, for example, in one or more embodiments, the threshold pressure PH can be set to a lower limit value of the pressure at which the refrigerant causes the disproportionation reaction at a maximum operating temperature TX of the refrigerant circuit 10 (i.e., a value on a curve indicating boundaries of the pressure and the temperature at which the refrigerant causes the disproportionation reaction). When this pressure value is close to a maximum operating pressure PX in the refrigerant circuit 10, the threshold pressure PH may be set to the maximum operating pressure PX. Here, the maximum operating pressure PX and the maximum operating temperature TX of the refrigerant circuit 10 are a pressure and a temperature at an upper operating limit, which are specified from the viewpoint of design strength of the refrigerant circuit 10 (i.e., the devices and the pipes constituting the refrigerant circuit 10).

With the configuration described above, until the pressure of the refrigerant on the discharge side of the compressor 21 reaches the threshold pressure PH, i.e., the predetermined condition causing the disproportionation reaction, the relief valve 43 does not operate, and the discharge side of the compressor 21 and the discharged refrigerant recovery receiver 41 are not communicated with each other (see a region in FIG. 3 where the relief valve does not operate). However, when the pressure of the refrigerant on the discharge side of the compressor 21 reaches the threshold pressure PH, i.e., the predetermined condition causing the disproportionation reaction, the relief valve 43 operates, and the discharge side of the compressor 21 and the discharged refrigerant recovery receiver 41 are communicated with each other, whereby the refrigerant on the discharge side of the compressor 21 is recovered to the discharged refrigerant recovery receiver 41 (see a region in FIG. 3 where the relief valve operates).

<Features>

According to one or more embodiments, as described above, in the air conditioner 1 including the refrigerant circuit 10 in which the refrigerant containing the fluorinated hydrocarbon of nature tending to cause the disproportionation reaction is enclosed, the discharged refrigerant recovery receiver 41 is branch-connected to the path between the discharge side of the compressor 21 and the gas side of the radiator (outdoor heat exchanger 23) through the discharged refrigerant relief mechanism (relief valve 43). Furthermore, when the refrigerant on the discharge side of the compressor 21 satisfies the predetermined condition, the discharge side of the compressor 21 and the discharged refrigerant recovery receiver 41 are communicated with each other, whereby the refrigerant on the discharge side of the compressor 21 is recovered to the discharged refrigerant recovery receiver 41. Here, since the predetermined condition is the second condition under which the refrigerant on the discharge side of the compressor 21 cause the disproportionation reaction, the abrupt pressure rise and the abrupt temperature rise generated with the disproportionation reaction can be suppressed by recovering the refrigerant on the discharge side of the compressor 21 to the discharged refrigerant recovery receiver 41.

As a result, in one or more embodiments, the damage of the refrigerant circuit 10 in the event of the refrigerant causing the disproportionation reaction can be reduced.

Just from the viewpoint of suppressing the abrupt pressure rise and the abrupt temperature rise, one conceivable solution is to branch-connect only the discharged refrigerant relief mechanism to the path between the discharge side of the compressor 21 and the gas side of the radiator through the discharged refrigerant branch pipe 42. With such a solution, however, the refrigerant and the reaction products cannot be recovered, and they are released to the outside of the refrigerant circuit 10. Another conceivable solution is to dispose a muffler between the discharge side of the compressor 21 and the gas side of the radiator. With such a solution, however, the muffler is brought into a state always filled with the refrigerant discharged from the compressor 21, and hence the action of suppressing the rise of the pressure and temperature is limited. Thus, the damage of the refrigerant circuit 10 in the event of the refrigerant causing the disproportionation reaction cannot be reduced with the provision of only the muffler. In summary, it is important to branch-connect the discharged refrigerant recovery receiver 41 to the path between the discharge side of the compressor 21 and the gas side of the radiator through the discharged refrigerant relief mechanism.

Furthermore, in one or more embodiments, the relief valve 43, i.e., the mechanical valve mechanism, is used as the discharged refrigerant relief mechanism. Therefore, by setting the specified pressure of the relief valve 43 to the threshold pressure PH corresponding to the predetermined condition under which the refrigerant on the discharge side of the compressor 21 causes the disproportionation reaction, it is possible to make the discharge side of the compressor 21 and the discharged refrigerant recovery receiver 41 communicated with each other so as to reduce the damage of the refrigerant circuit 10 in the event of the refrigerant causing the disproportionation reaction.

Moreover, the refrigerant containing HFO-1123, which is a refrigerant containing the fluorinated hydrocarbon of nature tending to cause the disproportionation reaction, can be used as the alternative refrigerant for HFC-32 or HFC-410A, while reducing the damage of the refrigerant circuit 10 in the event of the refrigerant causing the disproportionation reaction.

(4) Modification 1

Figure 4:
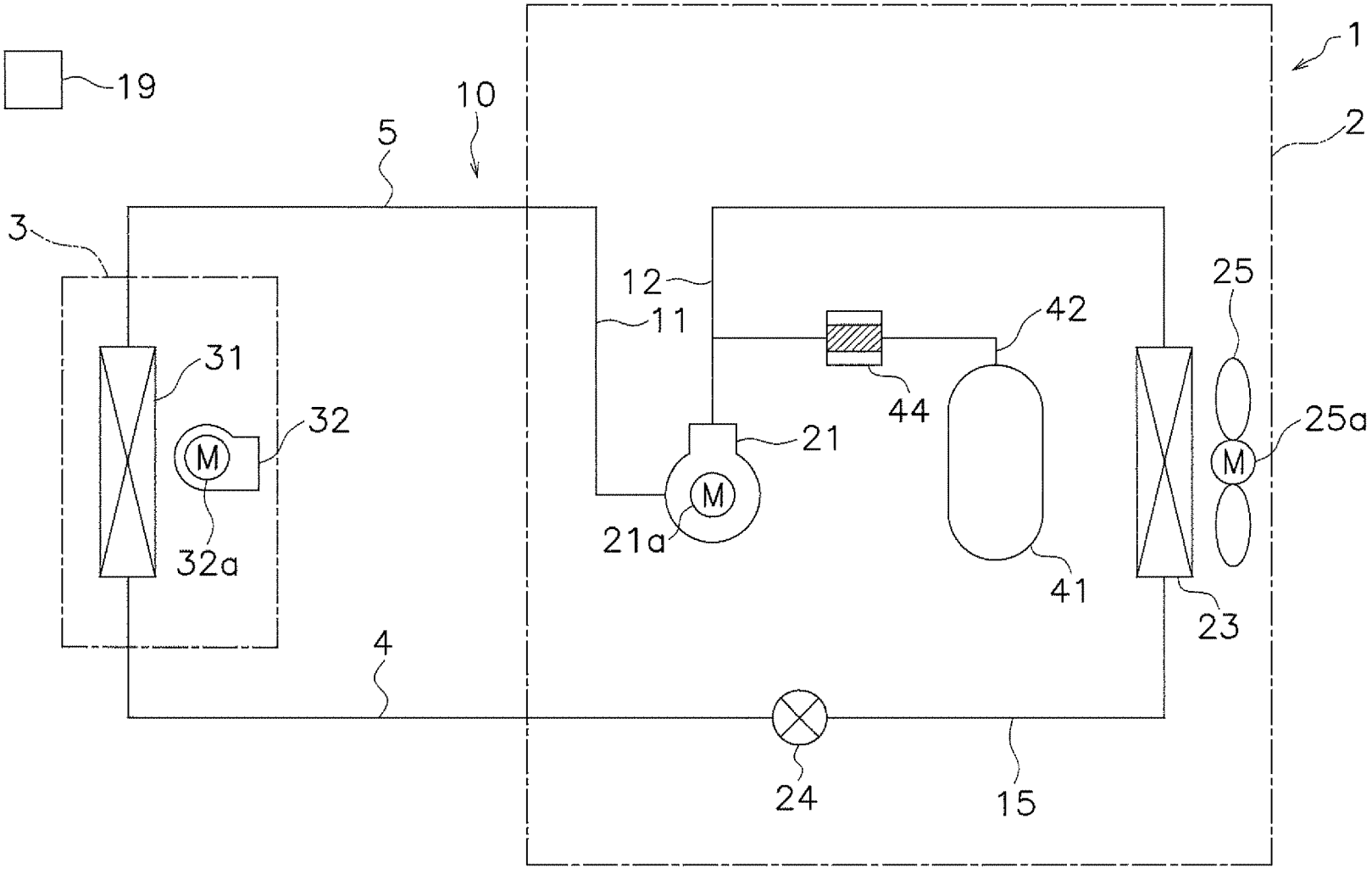
FIG. 4 is a schematic diagram of an air conditioner as one of a refrigeration apparatus according to one or more embodiments.

In the above embodiments, the relief valve 43, i.e., the mechanical valve mechanism, is used as the discharged refrigerant relief mechanism, but the discharged refrigerant relief mechanism is not limited to this. As illustrated in FIG. 4, in one or more embodiments, a fusible plug 44 in which a fusible material fuses at an atmosphere temperature higher than or equal to a specified temperature may be used as the discharged refrigerant relief mechanism.

Figure 5:
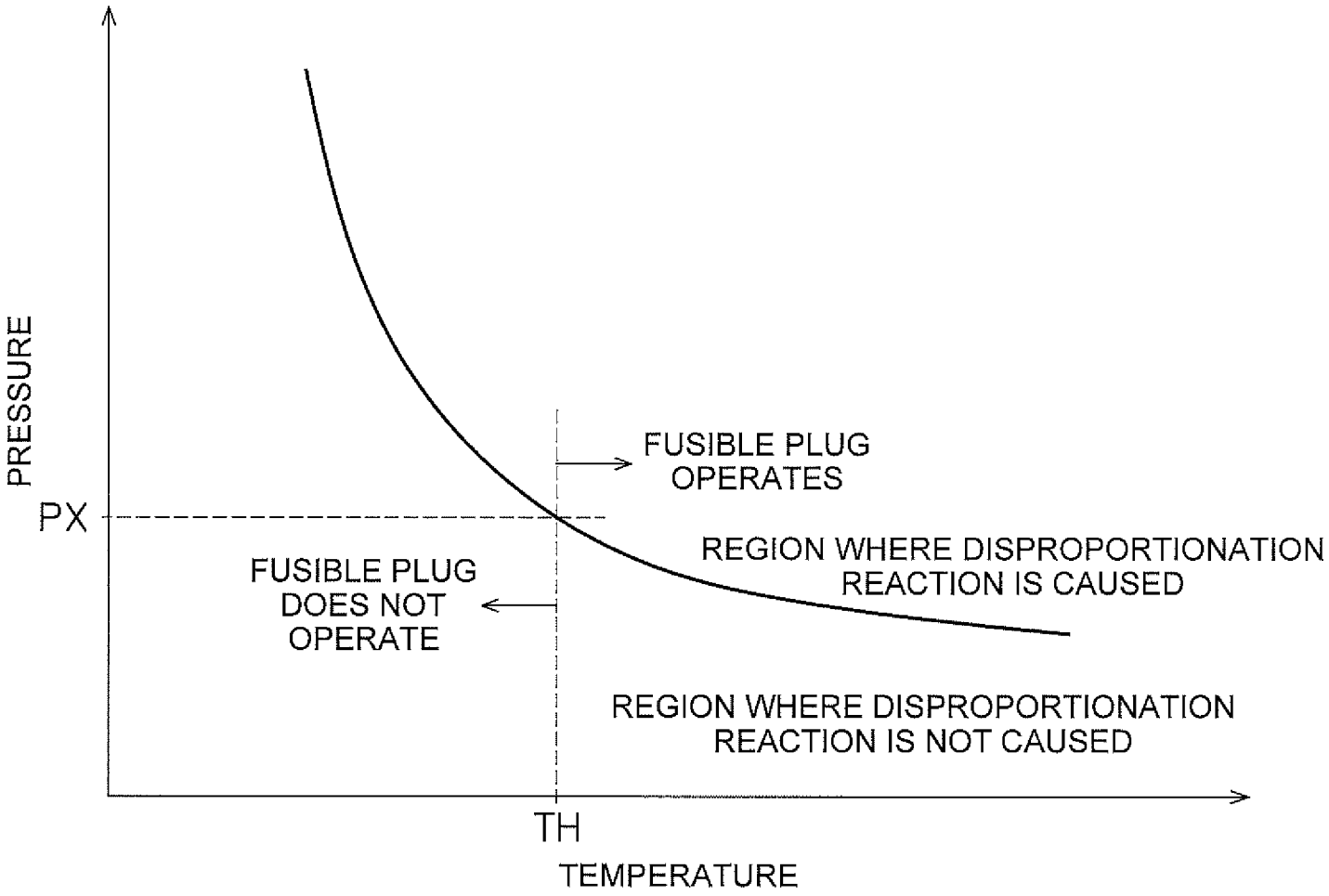
FIG. 5 is a graph depicting, when a fusible plug is used as the discharged refrigerant relief mechanism, a specified temperature (threshold temperature) of the fusible plug, which represents a predetermined condition causing the disproportionation reaction according to one or more embodiments.

The fusible plug 44 is a plug member in which the fusible material fuses when the atmosphere temperature (here, a temperature of the refrigerant on the discharge side of the compressor 21) is higher than or equal to the specified temperature. The specified temperature of the fusible plug 44 is set here to a threshold temperature TH corresponding to the predetermined condition (second condition) causing the disproportionation reaction. As illustrated in FIG. 5, for example, in one or more embodiments, the threshold temperature TH can be set to a lower limit value of the temperature at which the refrigerant causes the disproportionation reaction at the maximum operating pressure PX of the refrigerant circuit 10 (i.e., a value on a curve indicating boundaries of the pressure and the temperature at which the refrigerant causes the disproportionation reaction). When the lower limit value of the temperature is close to the maximum operating temperature TX in the refrigerant circuit 10, the threshold temperature TH may be set to the maximum operating temperature TX.

With the configuration described above, until the temperature of the refrigerant on the discharge side of the compressor 21 reaches the threshold temperature TH, i.e., the predetermined condition causing the disproportionation reaction, the fusible plug 44 does not operate, and the discharge side of the compressor 21 and the discharged refrigerant recovery receiver 41 are not communicated with each other (see a region in FIG. 5 where the fusible plug does not operate). However, when the temperature of the refrigerant on the discharge side of the compressor 21 reaches the threshold temperature TH, i.e., the predetermined condition causing the disproportionation reaction, the fusible plug 44 operates, and the discharge side of the compressor 21 and the discharged refrigerant recovery receiver 41 are communicated with each other, whereby the refrigerant on the discharge side of the compressor 21 is recovered to the discharged refrigerant recovery receiver 41 (see a region in FIG. 5 where the fusible plug operates).

Also with the configuration of Modification 1, as in the above embodiments, since the discharge side of the compressor 21 and the discharged refrigerant recovery receiver 41 are communicated with each other when the refrigerant on the discharge side of the compressor 21 satisfies the predetermined condition causing the disproportionation reaction, the damage of the refrigerant circuit 10 in the event of the refrigerant causing the disproportionation reaction can be reduced.

(5) Modification 2

In each of the above embodiments and Modification 1, the relief valve 43 or the fusible plug 44, i.e., the mechanical valve mechanism, is used as the discharged refrigerant relief mechanism, but the relief valve 43 and the fusible plug 44 may be both used as the discharged refrigerant relief mechanism.

Figure 6:
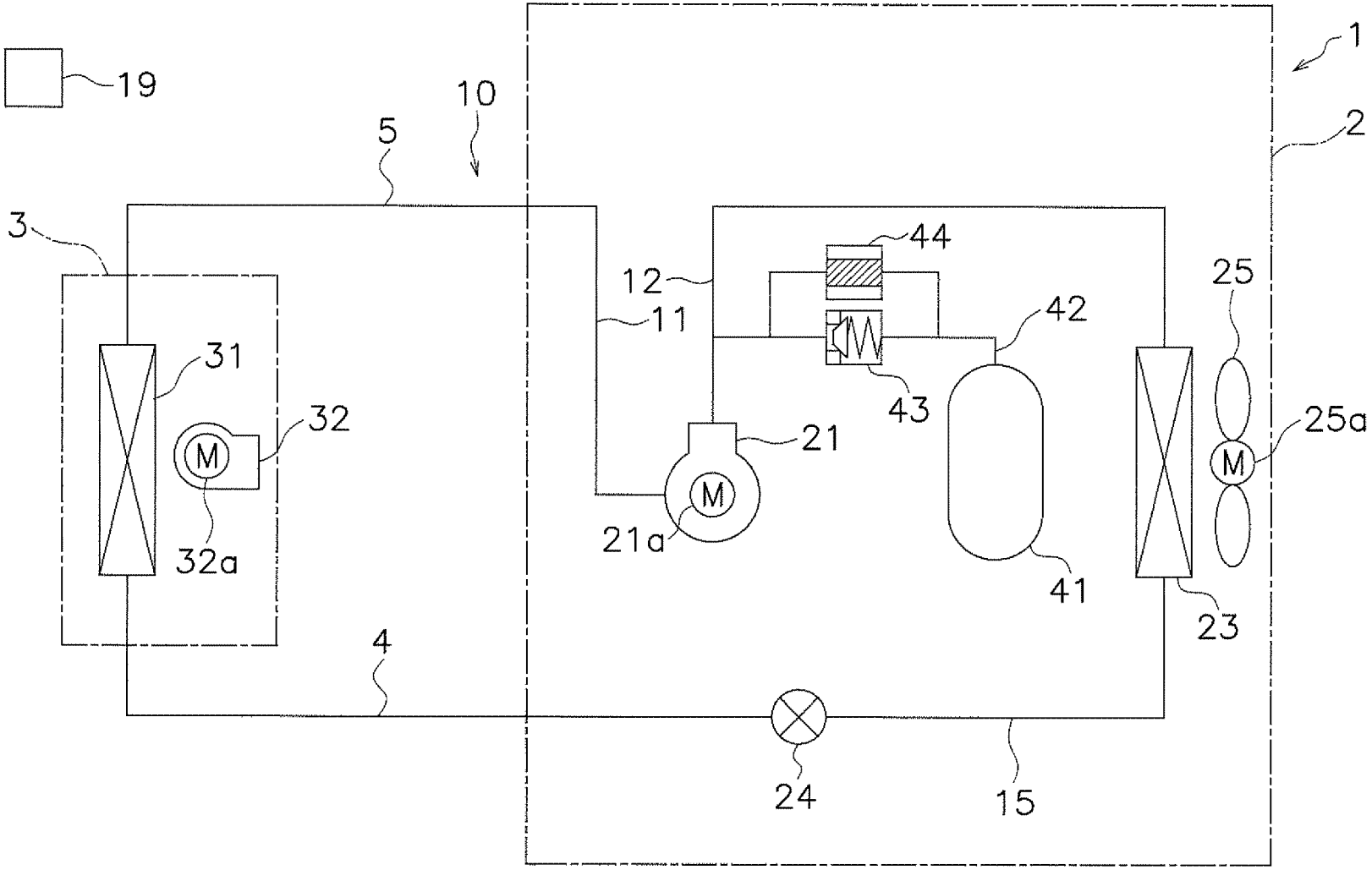
FIG. 6 is a schematic diagram of an air conditioner as one of a refrigeration apparatus according to one or more embodiments.

As illustrated in FIG. 6, for example, in one or more embodiments, the discharged refrigerant branch pipe 42 may be branched midway into two paths, and the relief valve 43 and the fusible plug 44 may be disposed in parallel in the discharged refrigerant branch pipe 42.

With such a configuration, operation/non-operation of the relief valve 43 explained in the above embodiments (see FIG. 3) and operation/non-operation of the fusible plug 44 explained in Modification 1 (see FIG. 5) are combined with each other. Specifically, when the pressure and the temperature of the refrigerant on the discharge side of the compressor 21 are in the region where the relief valve 43 does not operate and the fusible plug 44 does not operate, the discharge side of the compressor 21 and the discharged refrigerant recovery receiver 41 are not communicated with each other. When the pressure or the temperature reaches the region where the relief valve 43 operates or the fusible plug 44 operates, the discharge side of the compressor 21 and the discharged refrigerant recovery receiver 41 are communicated with each other, whereby the refrigerant on the discharge side of the compressor 21 is recovered to the discharged refrigerant recovery receiver 41.

With this configuration, as in the above embodiments and Modification 1, since the discharge side of the compressor 21 and the discharged refrigerant recovery receiver 41 are communicated with each other when the refrigerant on the discharge side of the compressor 21 satisfies the predetermined condition causing the disproportionation reaction, the damage of the refrigerant circuit 10 in the event of the refrigerant causing the disproportionation reaction can also be reduced.

(6) Modification 3

In the above embodiments and Modifications 1 and 2, from the viewpoint of suppressing the abrupt pressure rise and the abrupt temperature rise generated with the disproportionation reaction, the condition under which the refrigerant causes the disproportionation reaction, namely the first condition on the basis of the curve that is depicted in each of FIGS. 2, 3, and 5 and that indicates the boundaries of the pressure and the temperature at which the refrigerant causes the disproportionation reaction, is used as the predetermined condition for actuating the relief valve 43 or fusing the fusible plug 44, which is the discharged refrigerant relief mechanism.

When desiring to inhibit the refrigerant from causing the disproportionation reaction, however, another viewpoint should be considered that making the pressure and the temperature of the refrigerant hard to reach the conditions of the pressure and the temperature at which the refrigerant causes the disproportionation reaction.

Figure 7:
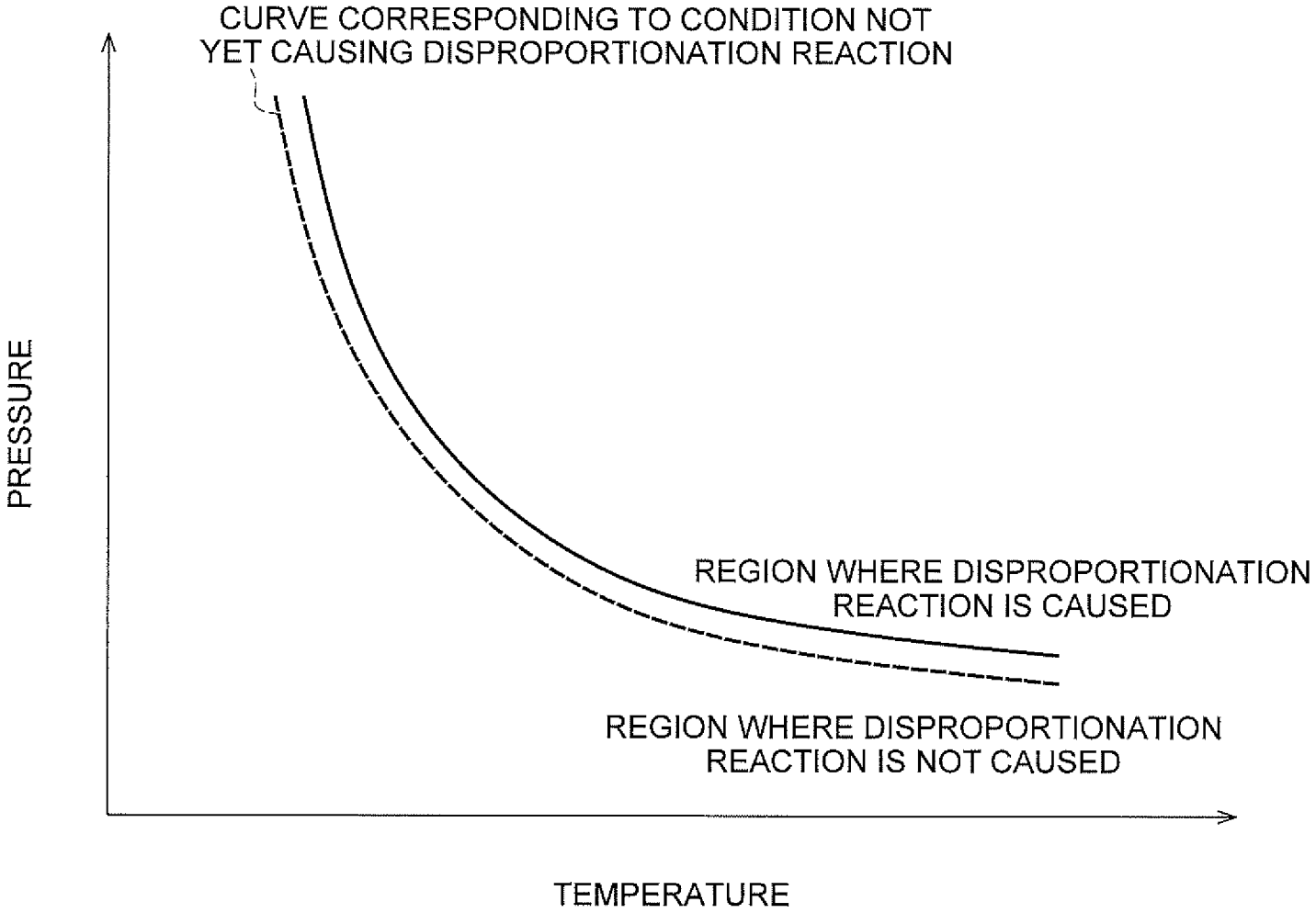
FIG. 7 is a graph depicting a relation between pressure and temperature at which the refrigerant causes the disproportionation reaction, the graph additionally including a curve corresponding to a condition not yet causing the disproportionation reaction according to one or more embodiments.

Therefore, unlike the above embodiments and Modifications 1 and 2, Modification 3 uses, instead of the condition under which the refrigerant causes the disproportionation reaction, a condition under which the refrigerant does not yet cause the disproportionation reaction, namely a first condition on the basis of, as illustrated in FIG. 7, in one or more embodiments, a curve (denoted by a dotted line) positioned lower than the curve (denoted by a solid line) indicating the boundaries of the pressure and the temperature at which the refrigerant causes the disproportionation reaction. The curve indicating the first condition is set to provide the pressure and the temperature lower than those provided by the curve indicating the second condition by about 10% to 30%, for example.

Figure 8:
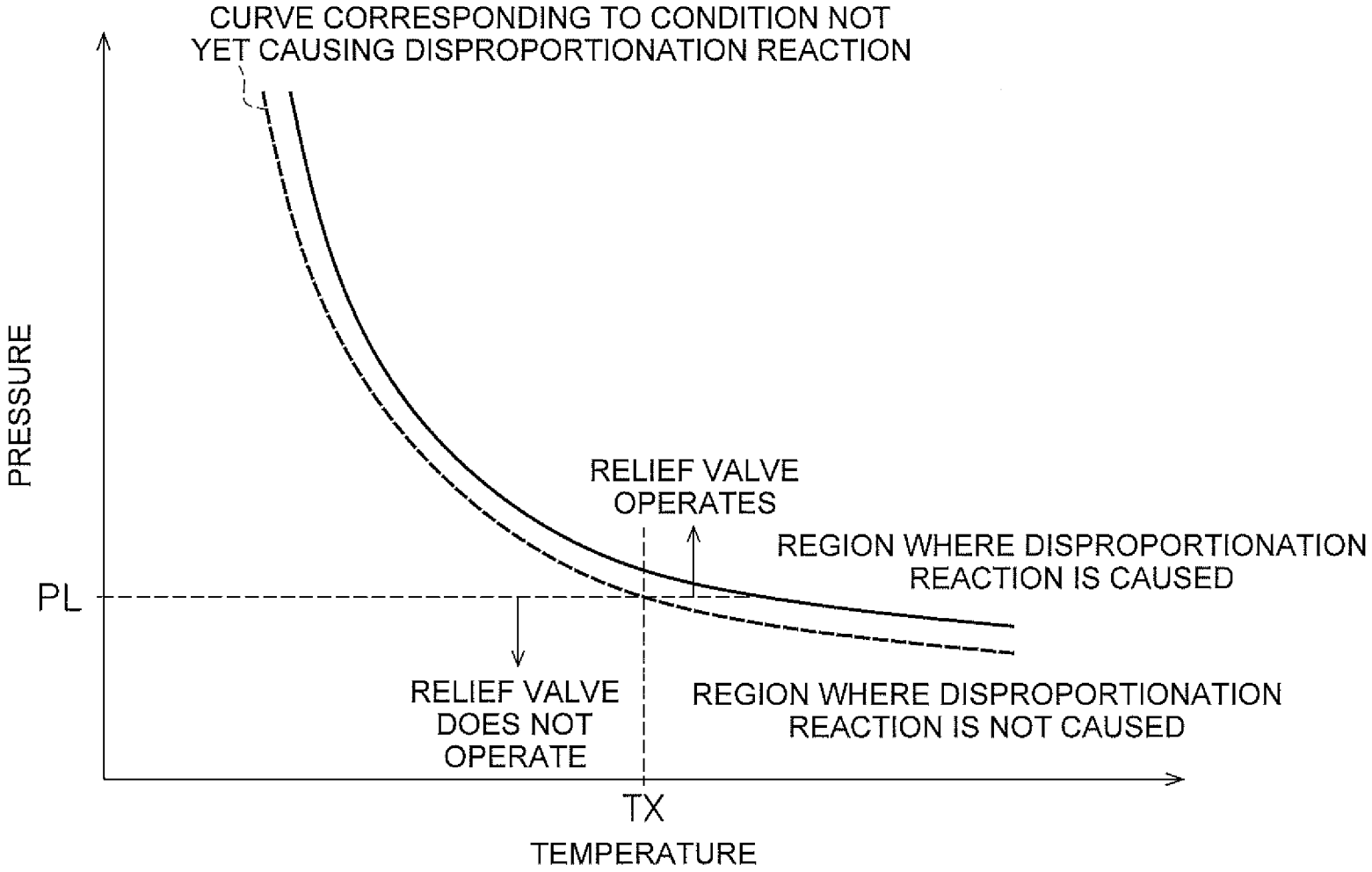
FIG. 8 is a graph depicting, when the relief valve is used as the discharged refrigerant relief mechanism, a specified pressure (threshold pressure) of the relief valve, which represents a predetermined condition not yet causing the disproportionation reaction according to one or more embodiments.

For example, when the relief valve 43 is used as the discharged refrigerant relief mechanism as in one or more embodiments and Modification 2, the specified pressure of the relief valve 43 is set, as illustrated in FIG. 8, to a threshold pressure PL corresponding to the predetermined condition (first condition) not yet causing the disproportionation reaction, namely a lower limit value of the pressure before the refrigerant causes the disproportionation reaction at the maximum operating temperature TX of the refrigerant circuit 10 (i.e., a value on the curve indicating the boundaries of the pressure and the temperature at which the refrigerant does not yet cause the disproportionation reaction).

Figure 9:
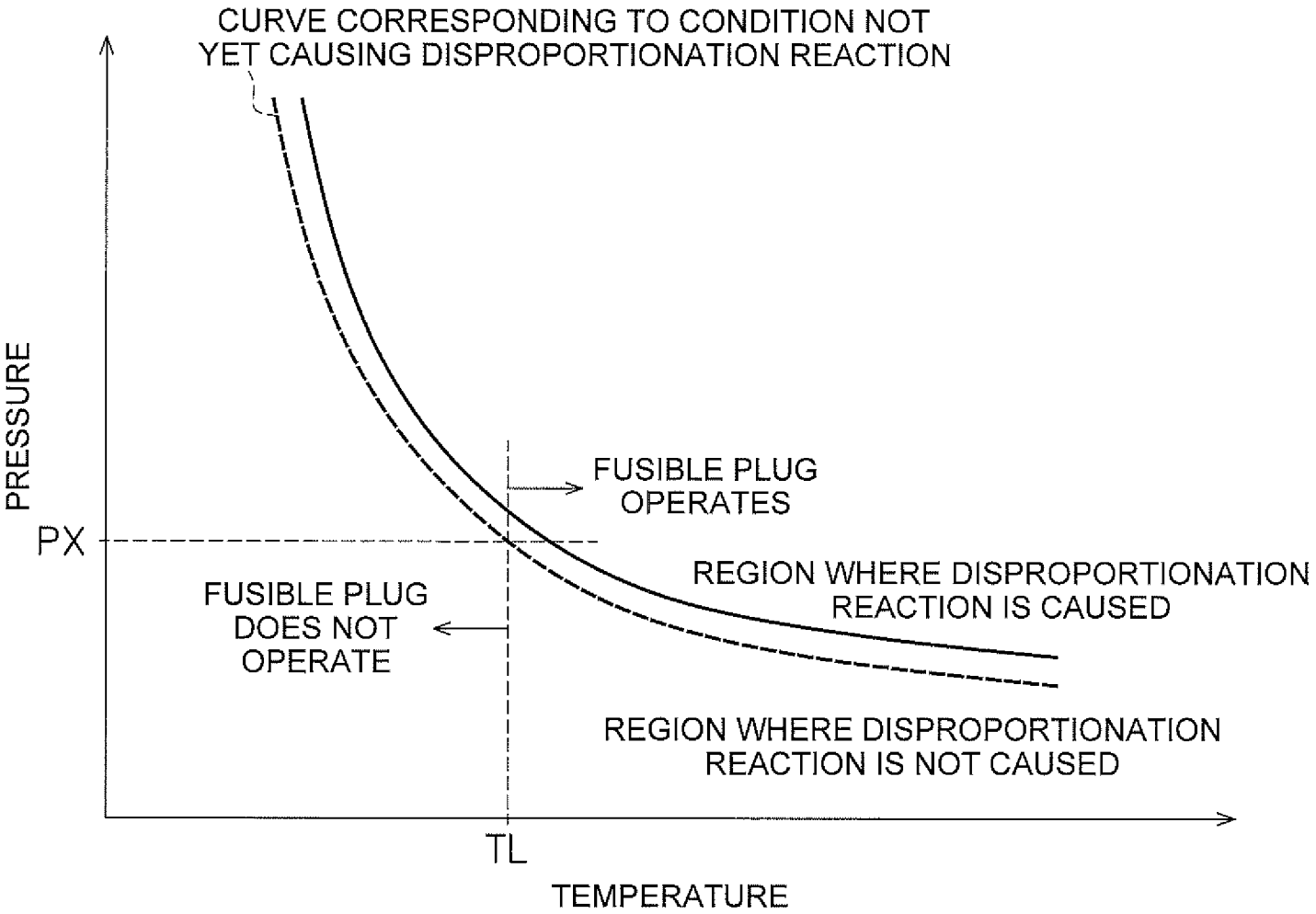
FIG. 9 is a graph depicting, when the fusible plug is used as the discharged refrigerant relief mechanism, a specified temperature (threshold temperature) of the fusible plug, which represents a predetermined condition not yet causing the disproportionation reaction according to one or more embodiments.

When the fusible plug 44 is used as the discharged refrigerant relief mechanism as in Modifications 1 and 2, the specified temperature of the fusible plug 44 is set, as illustrated in FIG. 9, to a threshold temperature TL corresponding to the predetermined condition (first condition) not yet causing the disproportionation reaction, namely a lower limit value of the temperature before the refrigerant causes the disproportionation reaction at the maximum operating pressure PX of the refrigerant circuit 10 (i.e., a value on the curve indicating the boundaries of the pressure and the temperature under which the refrigerant does not yet cause the disproportionation reaction).

With such a configuration, when the refrigerant on the discharge side of the compressor 21 satisfies the predetermined condition, the discharge side of the compressor 21 and the discharged refrigerant recovery receiver 41 are communicated with each other, whereby the refrigerant on the discharge side of the compressor 21 is recovered to the discharged refrigerant recovery receiver 41. Thus, the pressure and the temperature of the refrigerant are harder to satisfy the conditions of the pressure and the temperature under which the refrigerant causes the disproportionation reaction.

As a result, in this Modification, the refrigerant can be inhibited from causing the disproportionation reaction.

(7) Modification 4

Figure 10:
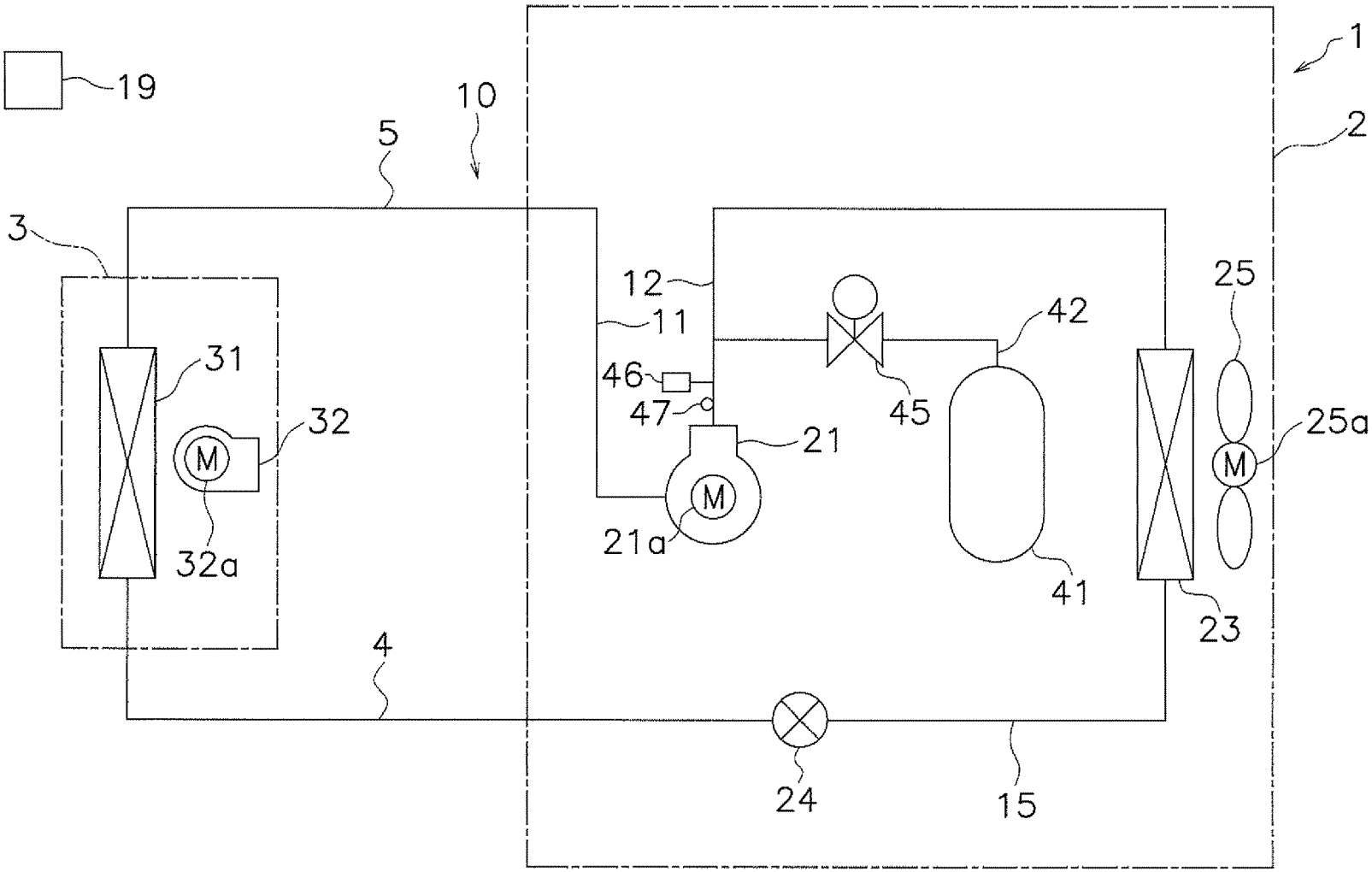
FIG. 10 is a schematic diagram of an air conditioner as one of a refrigeration apparatus according to one or more embodiments.

In the above embodiments and Modifications 1 to 3, the relief valve 43 and/or the fusible plug 44, i.e., the mechanical valve mechanisms, are used as the discharged refrigerant relief mechanism, but the discharged refrigerant relief mechanism is not limited to these. As illustrated in FIG. 10, in one or more embodiments, a first control valve 45 of which an open/closed state is controlled by the control unit 19 controlling the operation of the refrigerant circuit 10 may be used as the discharged refrigerant relief mechanism.

The first control valve 45 is a valve mechanism of which an open/closed state is controlled by the control unit 19. For example, an electric valve mechanism, such as an electromagnetic valve or an electrically powered valve, is used as the first control valve 45. In this Modification, discharged refrigerant sensors 46 and 47 for detecting the pressure and the temperature of the refrigerant on the discharge side of the compressor 21 are disposed. The control unit 19 determines, based on the pressure and the temperature of the refrigerant detected by the discharged refrigerant sensors 46 and 47, whether the predetermined condition is satisfied, and controls the first control valve 45 to be switched from the closed state to the open state if the predetermined condition is satisfied.

Figure 11:
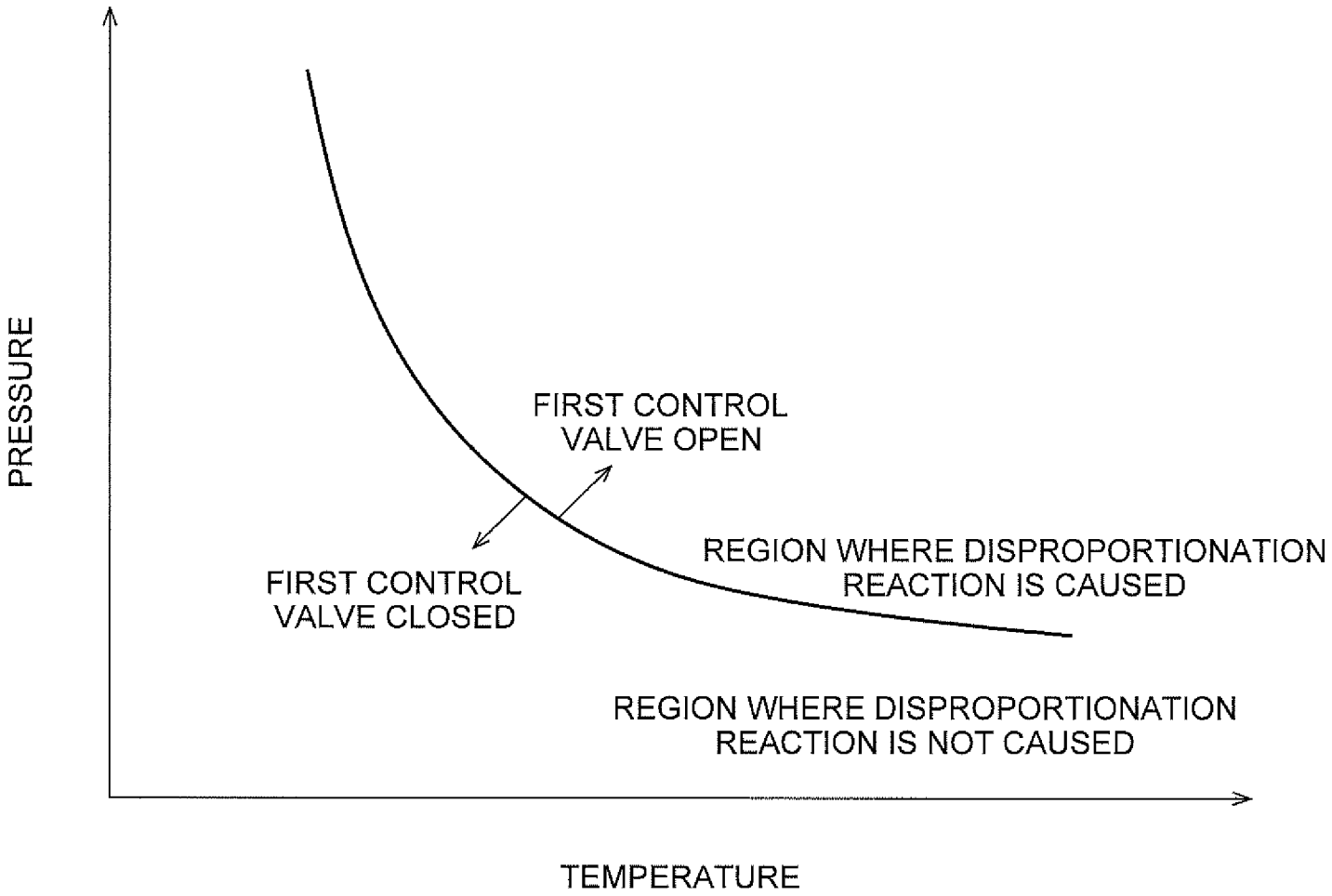
FIG. 11 is a graph depicting, when a first control valve is used as the discharged refrigerant relief mechanism, a relation between pressure and temperature of the first control valve, which represents a predetermined condition causing the disproportionation reaction according to one or more embodiments.

When the predetermined condition is set as the condition (the second condition) under which the refrigerant causes the disproportionation reaction, the predetermined condition can be determined as being satisfied, as illustrated in FIG. 11, in one or more embodiments, if both the pressure and the temperature of the refrigerant detected by the discharged refrigerant sensors 46 and 47 are higher than or equal to values on the curve indicating the boundaries of the pressure and the temperature at which the refrigerant causes the disproportionation reaction. The control unit 19 can perform this determination by comparing the pressure and the temperature of the refrigerant detected by the discharged refrigerant sensors 46 and 47 with the values on the curve indicating the boundaries of the pressure and the temperature at which the refrigerant causes the disproportionation reaction, those values being stored in advance.

Figure 12:
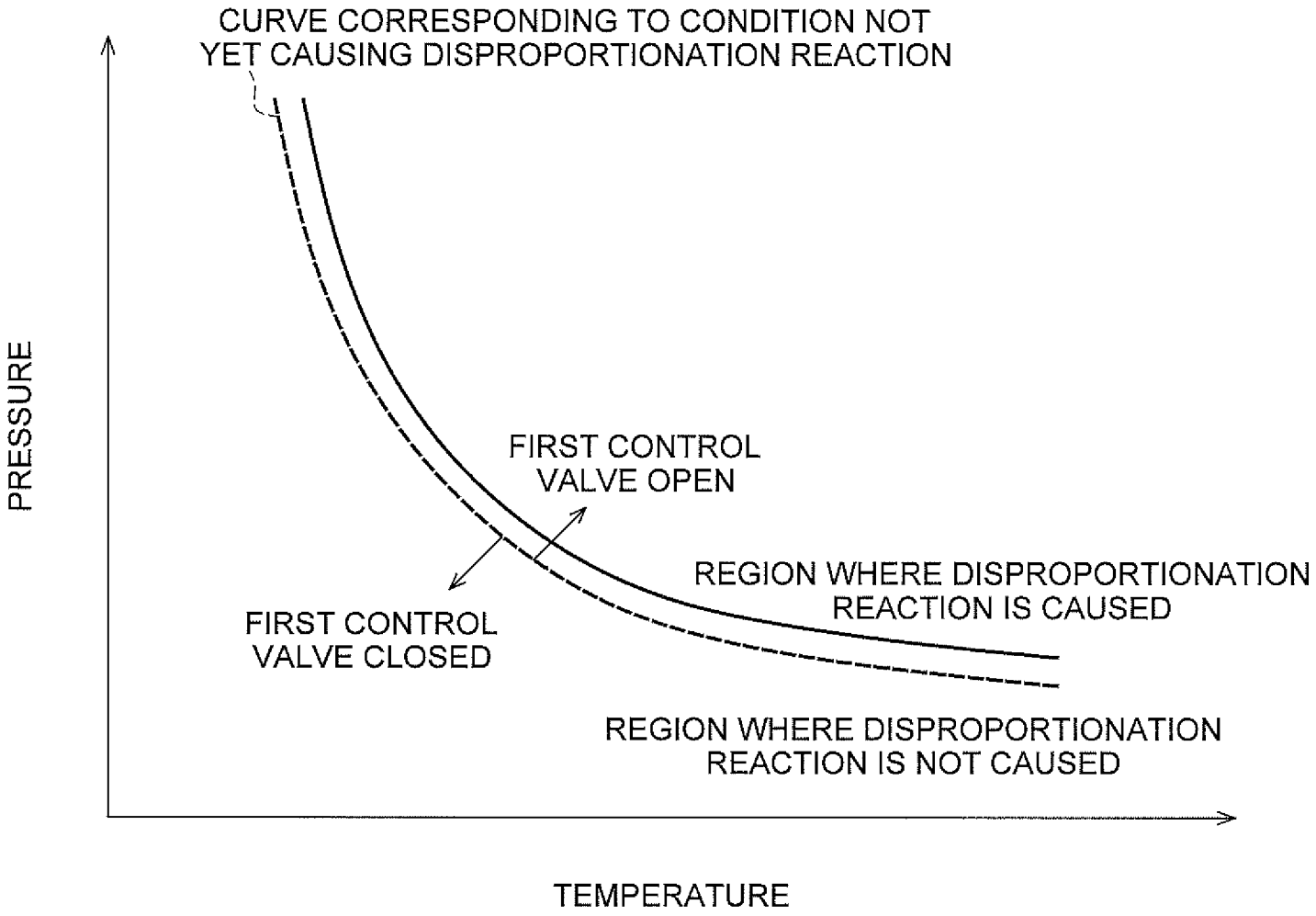
FIG. 12 is a graph depicting, when the first control valve is used as the discharged refrigerant relief mechanism, a relation between pressure and temperature of the first control valve, which represents a predetermined condition not yet causing the disproportionation reaction according to one or more embodiments.

When the predetermined condition is set as the condition (the first condition) under which the refrigerant does not yet cause the disproportionation reaction, the predetermined condition can be determined as being satisfied, as illustrated in FIG. 12, in one or more embodiments, if both the pressure and the temperature of the refrigerant detected by the discharged refrigerant sensors 46 and 47 are higher than or equal to values on the curve (denoted by a dotted line) indicating the boundaries of the pressure and the temperature at which the refrigerant relief does not yet cause the disproportionation reaction. The control unit 19 can perform this determination by comparing the pressure and the temperature of the refrigerant detected by the discharged refrigerant sensors 46 and 47 with the values on the curve indicating the boundaries of the pressure and the temperature at which the refrigerant does not yet cause the disproportionation reaction, those values being stored in advance.

With such a configuration, until both the pressure and the temperature of the refrigerant on the discharge side of the compressor 21 reach the pressure and the temperature representing the predetermined condition (the second condition causing the disproportionation reaction or the first condition not yet causing the disproportionation reaction), the control unit 19 controls the first control valve 45 to be held in the closed state, whereby the discharge side of the compressor 21 and the discharged refrigerant recovery receiver 41 are not communicated with each other (see a region where the first control valve is closed in each of FIGS. 11 and 12). However, when both the pressure and the temperature of the refrigerant on the discharge side of the compressor 21 reach the pressure and the temperature representing the predetermined condition (the second condition causing the disproportionation reaction or the first condition not yet causing the disproportionation reaction), the control unit 19 controls the first control valve 45 to be switched from the closed state to the open state, whereby the discharge side of the compressor 21 and the discharged refrigerant recovery receiver 41 are communicated with each other and the refrigerant on the discharge side of the compressor 21 is recovered to the discharged refrigerant recovery receiver 41 (see a region where the first control valve is open in each of FIGS. 11 and 12).

Also with the configuration described above, the control unit 19 determines, based on the pressure and the temperature of the refrigerant on the discharge side of the compressor 21, detected by the discharged refrigerant sensors 46 and 47, whether the predetermined condition under which the refrigerant on the discharge side of the compressor 21 causes the disproportionation reaction or does not yet cause the disproportionation reaction is satisfied. It is therefore possible, as in the above embodiments and Modifications 1 and 2, to make the discharge side of the compressor 21 and the discharged refrigerant recovery receiver 41 communicated with each other, and to reduce the damage of the refrigerant circuit in the event of the refrigerant causing the disproportionation reaction or to inhibit the refrigerant from causing the disproportionation reaction.

(8) Modification 5

In Modification 4, the control unit 19 determines whether both the pressure and the temperature of the refrigerant on the discharge side of the compressor 21 reach the pressure and the temperature representing the predetermined condition (i.e., the second condition causing the disproportionation reaction or the first condition not yet causing the disproportionation reaction) and controls the open/closed state of the first control valve 45, but embodiments of the present invention are not limited to this configuration.

As illustrated in FIGS. 11 and 12, etc., in one or more embodiments, a relation between the pressure and the temperature at which the refrigerant causes the disproportionation reaction is a substantially inverse relation. In other words, there is a relation that the disproportionation reaction is caused when a multiplication value (=pressure×temperature) of the pressure and the temperature of the refrigerant is higher than or equal to a certain value.

Thus, in this Modification, the determination as to whether the predetermined condition is satisfied is made by determining whether the multiplication value of the pressure and the temperature of the refrigerant on the discharge side of the compressor 21 is higher than or equal to a threshold multiplication value PTH or PTL at which the refrigerant causes the disproportionation reaction or does not yet cause the disproportionation reaction. Here, the threshold multiplication value PTH is a value corresponding to the second condition under which the refrigerant causes the disproportionation reaction. The threshold multiplication value PTL is a value corresponding to the first condition under which the refrigerant does not yet cause the disproportionation reaction. The threshold multiplication value PTL is set to a value smaller than the threshold multiplication value PTH by about 10% to 60%.

With such a configuration, until the multiplication value of the pressure and the temperature of the refrigerant on the discharge side of the compressor 21 reaches the threshold multiplication value PTH or PTL corresponding to the predetermined condition (i.e., the second condition causing the disproportionation reaction or the first condition not yet causing the disproportionation reaction), the control unit 19 controls the first control valve 45 to be held in the closed state, and the discharge side of the compressor 21 and the discharged refrigerant recovery receiver 41 are not communicated with each other. However, when the multiplication value of the pressure and the temperature of the refrigerant on the discharge side of the compressor 21 reaches the threshold multiplication value PTH or PTL corresponding to the predetermined condition (i.e., the second condition causing the disproportionation reaction or the first condition not yet causing the disproportionation reaction), the control unit 19 controls the first control valve 45 to be switched from the closed state to the open state, whereby the discharge side of the compressor 21 and the discharged refrigerant recovery receiver 41 are communicated with each other and the refrigerant on the discharge side of the compressor 21 is recovered to the discharged refrigerant recovery receiver 41.

Also with the configuration described above, the control unit 19 can appropriately determine, based on the pressure and the temperature of the refrigerant on the discharge side of the compressor 21, detected by the discharged refrigerant sensors 46 and 47, whether the predetermined condition under which the refrigerant on the discharge side of the compressor 21 causes the disproportionation reaction or does not yet cause the disproportionation reaction is satisfied. It is hence possible, as in Modification 4, to make the discharge side of the compressor 21 and the discharged refrigerant recovery receiver 41 communicated with each other, and to reduce the damage of the refrigerant circuit in the event of the refrigerant causing the disproportionation reaction or to inhibit the refrigerant from causing the disproportionation reaction.

(9) Modification 6

In Modification 4, the control unit 19 determines whether both the pressure and the temperature of the refrigerant on the discharge side of the compressor 21 reach the pressure and the temperature representing the predetermined condition (i.e., the second condition causing the disproportionation reaction or the first condition not yet causing the disproportionation reaction) and controls the open/closed state of the first control valve 45, but embodiments of the present invention are not limited to this configuration.

From the viewpoint of strength design for the refrigerant circuit 10, it should be determined whether the refrigerant on the discharge side of the compressor 21 satisfies the predetermined condition causing the disproportionation reaction or not yet causing the disproportionation reaction in consideration of the maximum operating pressure PX of the refrigerant circuit 10.

Figure 13:
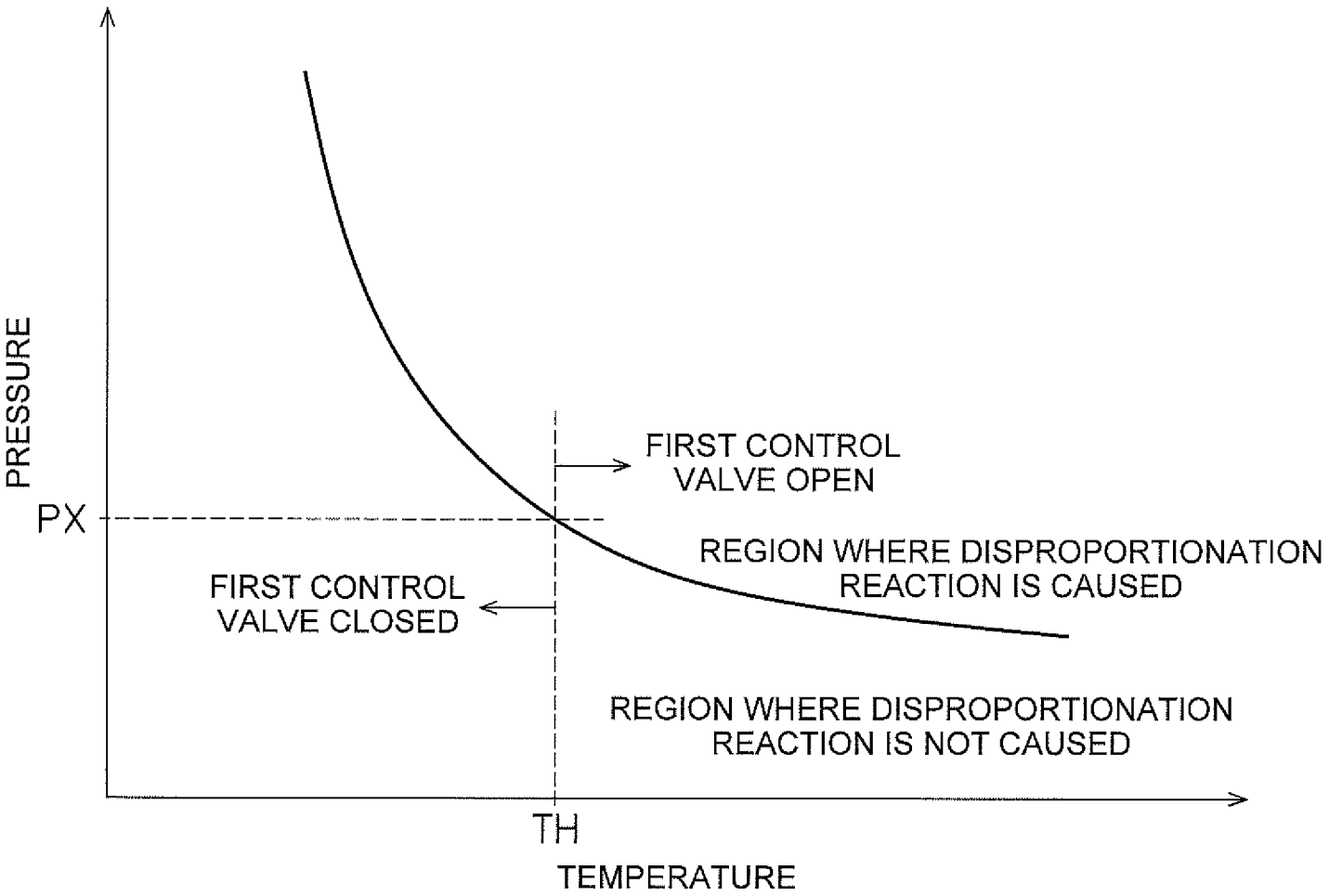
FIG. 13 is a graph depicting a threshold temperature, which represents a predetermined condition causing the disproportionation reaction, when the first control valve is used as the discharged refrigerant relief mechanism according to one or more embodiments.
Figure 14:
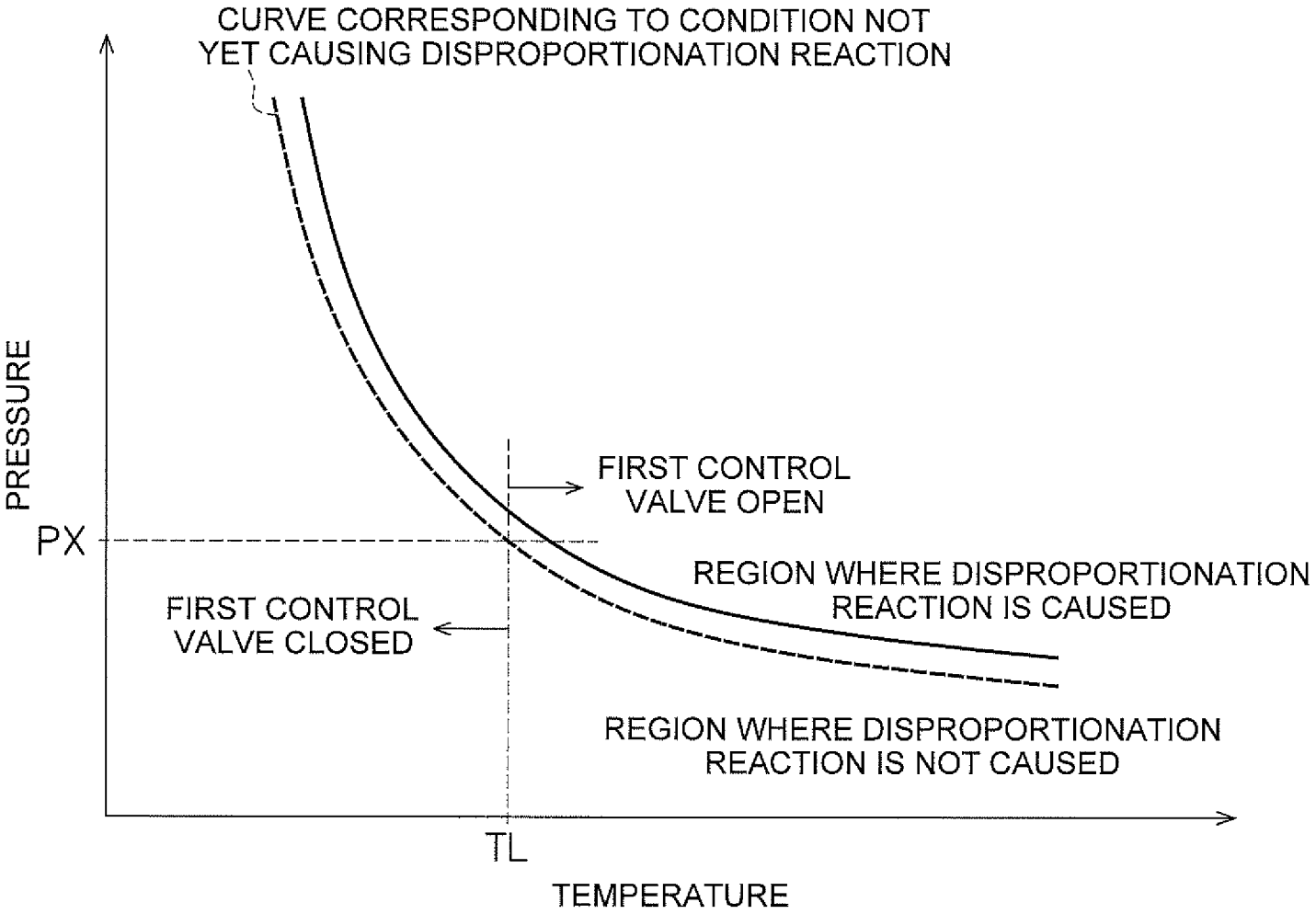
FIG. 14 is a graph depicting a threshold temperature, which represents a predetermined condition not yet causing the disproportionation reaction, when the first control valve is used as the discharged refrigerant relief mechanism according to one or more embodiments.

Thus, in this Modification, the determination as to whether the predetermined condition is satisfied is made, as illustrated in FIGS. 13 and 14, by determining whether the temperature of the refrigerant on the discharge side of the compressor 21 is higher than or equal to the threshold temperature TH or TL at which the refrigerant causes the disproportionation reaction or does not yet cause the disproportionation reaction at the maximum operating pressure PX of the refrigerant circuit 10. Here, the threshold temperature TH is a value corresponding to the second condition under which the refrigerant causes the disproportionation reaction. The threshold temperature TL is a value corresponding to the first condition under which the refrigerant does not yet cause the disproportionation reaction. The threshold temperature TL is set to a value lower than the threshold temperature TH by about 10% to 30%.

With such a configuration, until the temperature of the refrigerant on the discharge side of the compressor 21 reaches the threshold temperature TH or TL corresponding to the predetermined condition (the second condition causing the disproportionation reaction or the first condition not yet causing the disproportionation reaction), the control unit 19 controls the first control valve 45 to be held in the closed state, whereby the discharge side of the compressor 21 and the discharged refrigerant recovery receiver 41 are not communicated with each other (see a region where the first control valve is closed in each of FIGS. 13 and 14). However, when the temperature of the refrigerant on the discharge side of the compressor 21 reaches the threshold temperature TH or TL corresponding to the predetermined condition (the second condition causing the disproportionation reaction or the first condition not yet causing the disproportionation reaction), the control unit 19 controls the first control valve 45 to be switched from the closed state to the open state, whereby the discharge side of the compressor 21 and the discharged refrigerant recovery receiver 41 are communicated with each other and the refrigerant on the discharge side of the compressor 21 is recovered to the discharged refrigerant recovery receiver 41 (see a region where the first control valve is opened in each of FIGS. 13 and 14).

Also with the configuration described above, the control unit 19 can appropriately determine, based on the temperature of the refrigerant on the discharge side of the compressor 21, detected by the discharged refrigerant sensor 47, whether the predetermined condition under which the refrigerant on the discharge side of the compressor 21 causes the disproportionation reaction or does not yet cause the disproportionation reaction is satisfied. It is hence possible, as in Modification 4, to make the discharge side of the compressor 21 and the discharged refrigerant recovery receiver 41 communicated with each other, and to reduce the damage of the refrigerant circuit in the event of the refrigerant causing the disproportionation reaction or to inhibit the refrigerant from causing the disproportionation reaction.

(10) Modification 7

In Modifications 4 to 6, the discharged refrigerant recovery receiver 41 is branch-connected to the path between the discharge side of the compressor 21 and the gas side of the radiator through the first control valve 45 that serves as the discharged refrigerant relief mechanism, and the control unit 19 controls the open/closed state of the first control valve 45 depending on whether the predetermined condition (i.e., the second condition causing the disproportionation reaction or the first condition not yet causing the disproportionation reaction) is satisfied.

Figure 15:
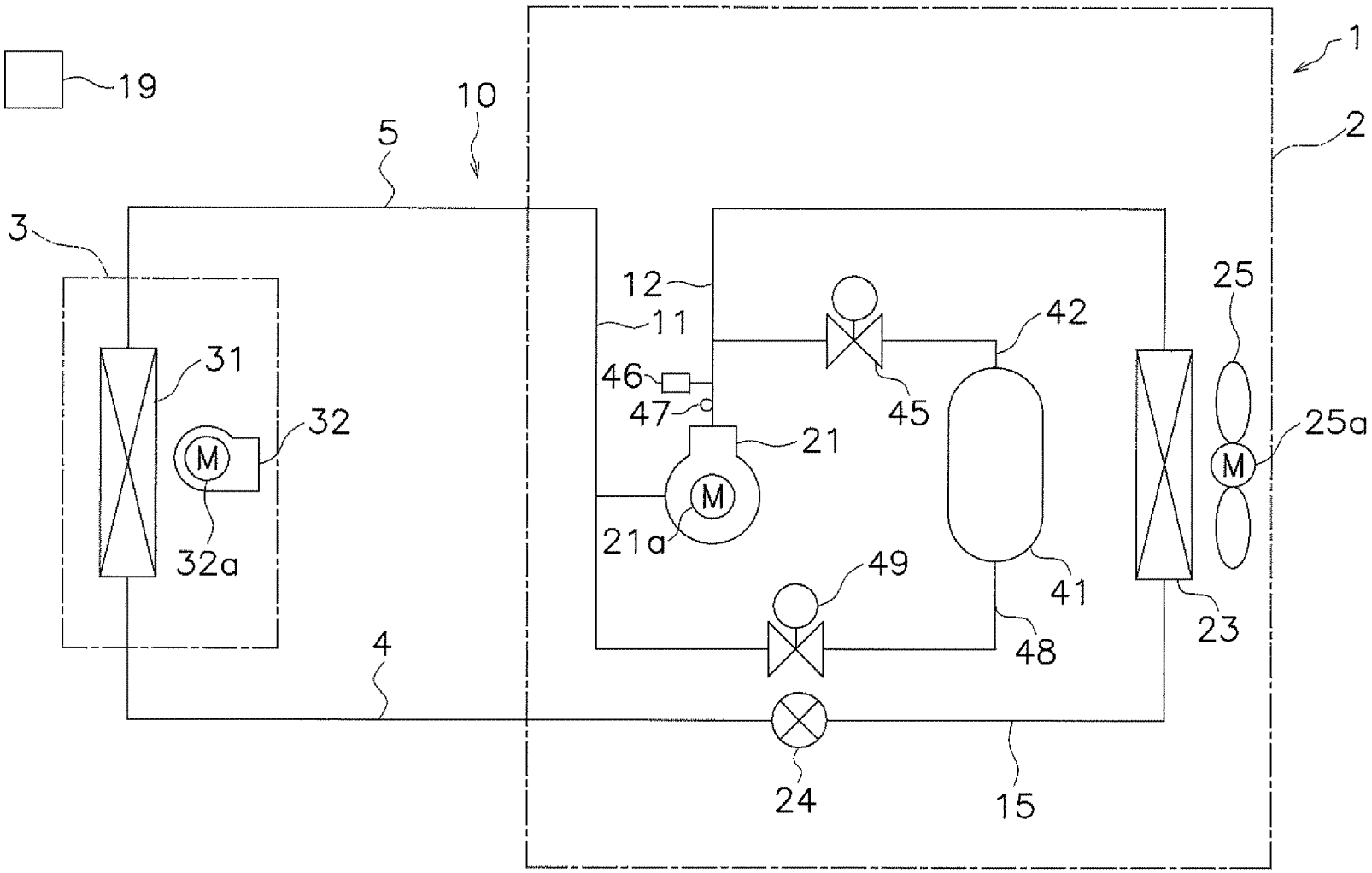
FIG. 15 is a schematic diagram of an air conditioner as one of a refrigeration apparatus according to one or more embodiments.

In addition to the above configuration, as illustrated in FIG. 15, in one or more embodiments, a refrigerant suction return pipe 48 connecting the discharged refrigerant recovery receiver 41 and the suction side of the compressor 21 may be disposed, and a second control valve 49 may be disposed in the refrigerant suction return pipe 48. Here, the second control valve 49 is a valve mechanism of which an open/closed state is controlled by the control unit 19. For example, an electric valve mechanism, such as an electromagnetic valve or an electrically powered valve, is used as the second control valve 49.

In this Modification, control for opening and closing the first control valve 45 and the second control valve 49 can be performed as follows by utilizing the first condition not yet causing the disproportionation reaction and the second condition causing the disproportionation reaction. Here, the description is made in connection with an example in which the second condition and the first condition in Modification 6 (i.e., whether the temperature of the refrigerant on the discharge side of the compressor 21 is higher than or equal to the threshold temperatures TH or TL) are used as the predetermined conditions (i.e., the second condition and the first condition). However, embodiments of the present invention are not limited to that case. The second condition and the first condition may be each given as the predetermined condition in Modification 4 (namely, whether both the pressure and the temperature of the refrigerant on the discharge side of the compressor 21 are higher than or equal to the values on the curve indicating the boundaries of the pressure and the temperature with respect to the disproportionation reaction), or may be each given as the predetermined condition in Modification 5 (namely, whether the multiplication value of the pressure and the temperature of the refrigerant on the discharge side of the compressor 21 is higher than or equal to the threshold multiplication values PTH or PTL).

Figure 16:
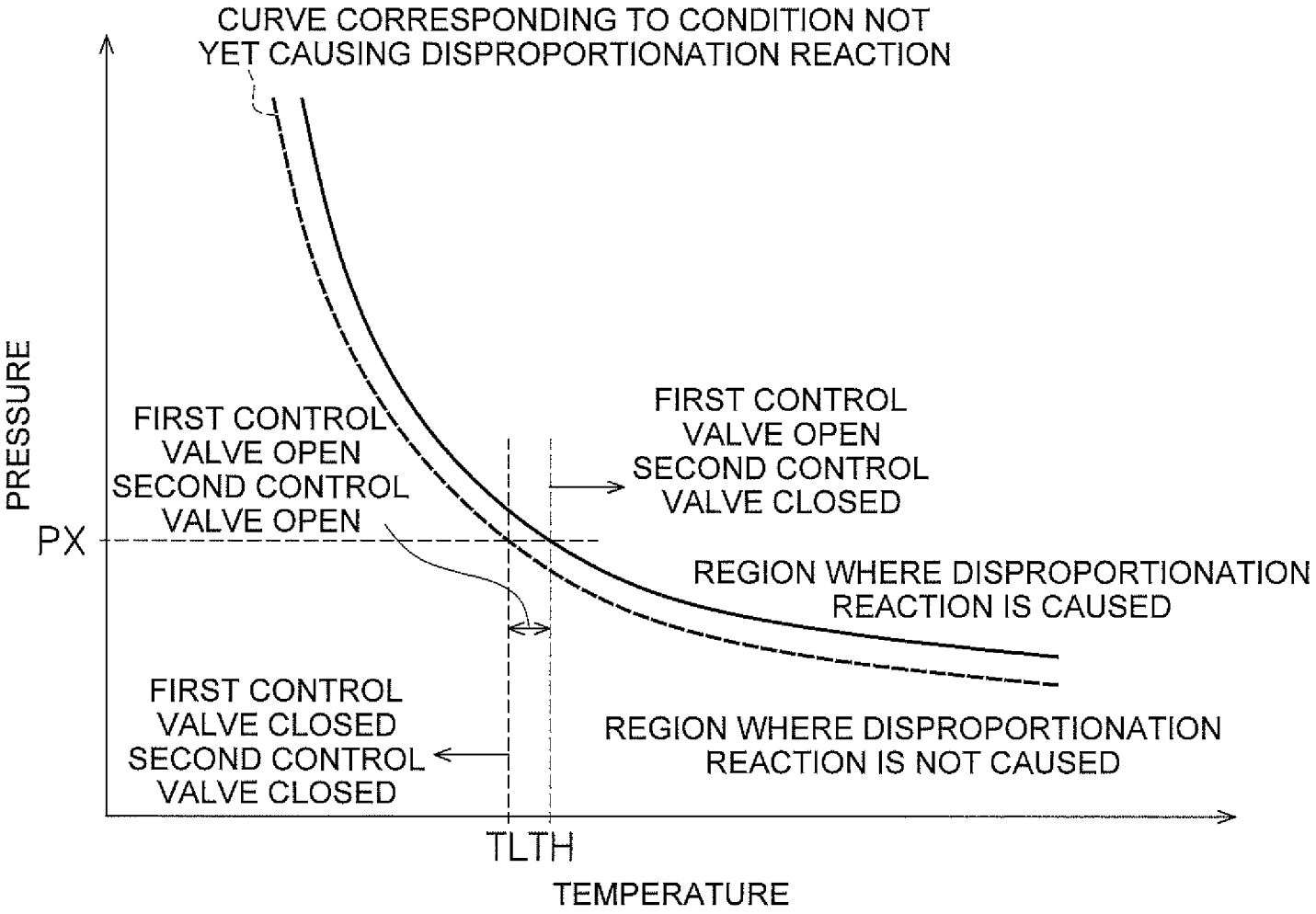
FIG. 16 is a graph depicting a threshold temperature, which represents a predetermined condition causing the disproportionation reaction or not yet causing the disproportionation reaction, when the first control valve is used as the discharged refrigerant relief mechanism and a second control valve is added according to one or more embodiments.

First, until the temperature of the refrigerant on the discharge side of the compressor 21 reaches the threshold temperature TL corresponding to the first condition not yet causing the disproportionation reaction, the pressure and the temperature of the refrigerant on the discharge side of the compressor 21 are in a normal state. Therefore, the control unit 19 controls the first control valve 45 to be in the closed state and controls the second control valve 49 to be in the closed state. Thus, the operation of the air conditioner 1 is performed in a state in which the discharge side of the compressor 21 and the discharged refrigerant recovery receiver 41 are not communicated with each other, and in which the discharged refrigerant recovery receiver 41 and the suction side of the compressor 21 are not communicated with each other (see a region in FIG. 16 where the first and second control valves are closed).

When the temperature of the refrigerant on the discharge side of the compressor 21 reaches the threshold temperature TL corresponding to the first condition not yet causing the disproportionation reaction, the pressure and the temperature of the refrigerant on the discharge side of the compressor 21 are in a state close to conditions of the pressure and the temperature under which the refrigerant causes the disproportionation reaction. Therefore, the control unit 19 controls the first control valve 45 to be in the open state and controls the second control valve 49 to be in the open state. Thus, the discharge side of the compressor 21 and the discharged refrigerant recovery receiver 41 are communicated with each other, and the discharged refrigerant recovery receiver 41 and the suction side of the compressor 21 are communicated with each other. As a result, after temporarily recovering the refrigerant on the discharge side of the compressor 21 into the discharged refrigerant recovery receiver 41, the recovered refrigerant can be returned to the suction side of the compressor 21. The operation of the air conditioner 1 is continued (see a region in FIG. 16 where the first and second control valves are open).

When the temperature of the refrigerant on the discharge side of the compressor 21 reaches the threshold temperature TH corresponding to the second condition causing the disproportionation reaction, the pressure and the temperature of the refrigerant on the discharge side of the compressor 21 are reaching the conditions of the pressure and the temperature under which the refrigerant causes the disproportionation reaction. Therefore, the control unit 19 controls the first control valve 45 to be in the open state and controls the second control valve 49 to be in the closed state. This brings about a state in which the discharge side of the compressor 21 and the discharged refrigerant recovery receiver 41 are communicated with each other, and in which the discharged refrigerant recovery receiver 41 and the suction side of the compressor 21 are not communicated with each other. In such a state, the refrigerant on the discharge side of the compressor 21 can be recovered and accumulated in the discharged refrigerant recovery receiver 41. Thereafter, the operation of the air conditioner 1 is stopped by stopping the compressor 21 (see a region in FIG. 16 where the first control valve is open and the second control valve is closed).

In the configuration of this Modification, as described above, the discharged refrigerant recovery receiver 41 and the suction side of the compressor 21 are connected to each other through the second control valve 49, and both the first control valve 45 and the second control valve 49 are in the open state when the first condition under which the refrigerant does not yet cause the disproportionation reaction is satisfied. Therefore, the refrigerant on the discharge side of the compressor 21 can be temporarily recovered into the discharged refrigerant recovery receiver 41, and the pressure and the temperature of the refrigerant can be made harder to reach the conditions of the pressure and the temperature under which the refrigerant causes the disproportionation reaction. As a result, in this Modification, the operation can be continued while the refrigerant is inhibited from causing the disproportionation reaction.

Also in the configuration of this Modification, as described above, when the second condition under which the refrigerant causes the disproportionation reaction is satisfied, the first control valve 45 is in the open state and the second control valve 49 is in the closed state. Therefore, the refrigerant on the discharge side of the compressor 21 can be recovered and accumulated in the discharged refrigerant recovery receiver 41, and the abrupt pressure rise and the abrupt temperature rise generated with the disproportionation reaction can be suppressed. As a result, in this Modification, the operation can be safely stopped while the damage of the refrigerant circuit in the event of the refrigerant causing the disproportionation reaction is reduced.

(11) Modification 8

In the above embodiments and Modifications 1 to 7, a cooling mechanism for cooling the discharged refrigerant recovery receiver 41 may be disposed. The cooling mechanism may be of the type cooling the discharged refrigerant recovery receiver 41 by air. The following description is made in connection with an example in which the cooling mechanism is disposed in the configuration using the relief valve 43 as the discharged refrigerant relief mechanism, but embodiments of the present invention are not limited to that case. The cooling mechanism may be disposed in the configuration using the fusible plug 44 or the first control valve 45 as the discharged refrigerant relief mechanism.

In this Modification, the cooling mechanism described below can cool the refrigerant recovered to the discharged refrigerant recovery receiver 41 and can therefore increase recovery performance when the refrigerant on the discharge side of the compressor 21 is recovered to the discharged refrigerant recovery receiver 41. Thus, when the predetermined condition is the condition (the second condition) under which the refrigerant on the discharge side of the compressor 21 causes the disproportionation reaction, the abrupt pressure rise and the abrupt temperature rise generated with the disproportionation reaction can be further suppressed. When the predetermined condition is the condition (the second condition) under which the refrigerant on the discharge side of the compressor 21 dose not yet cause the disproportionation reaction, the pressure and the temperature of the refrigerant can be made harder to reach the conditions of the pressure and the temperature under which the refrigerant causes the disproportionation reaction. It is hence possible in this Modification to further reduce the damage of the refrigerant circuit 10 in the event of the refrigerant causing the disproportionation reaction, or to more reliably inhibit the refrigerant from causing the disproportionation reaction.

Figure 17:
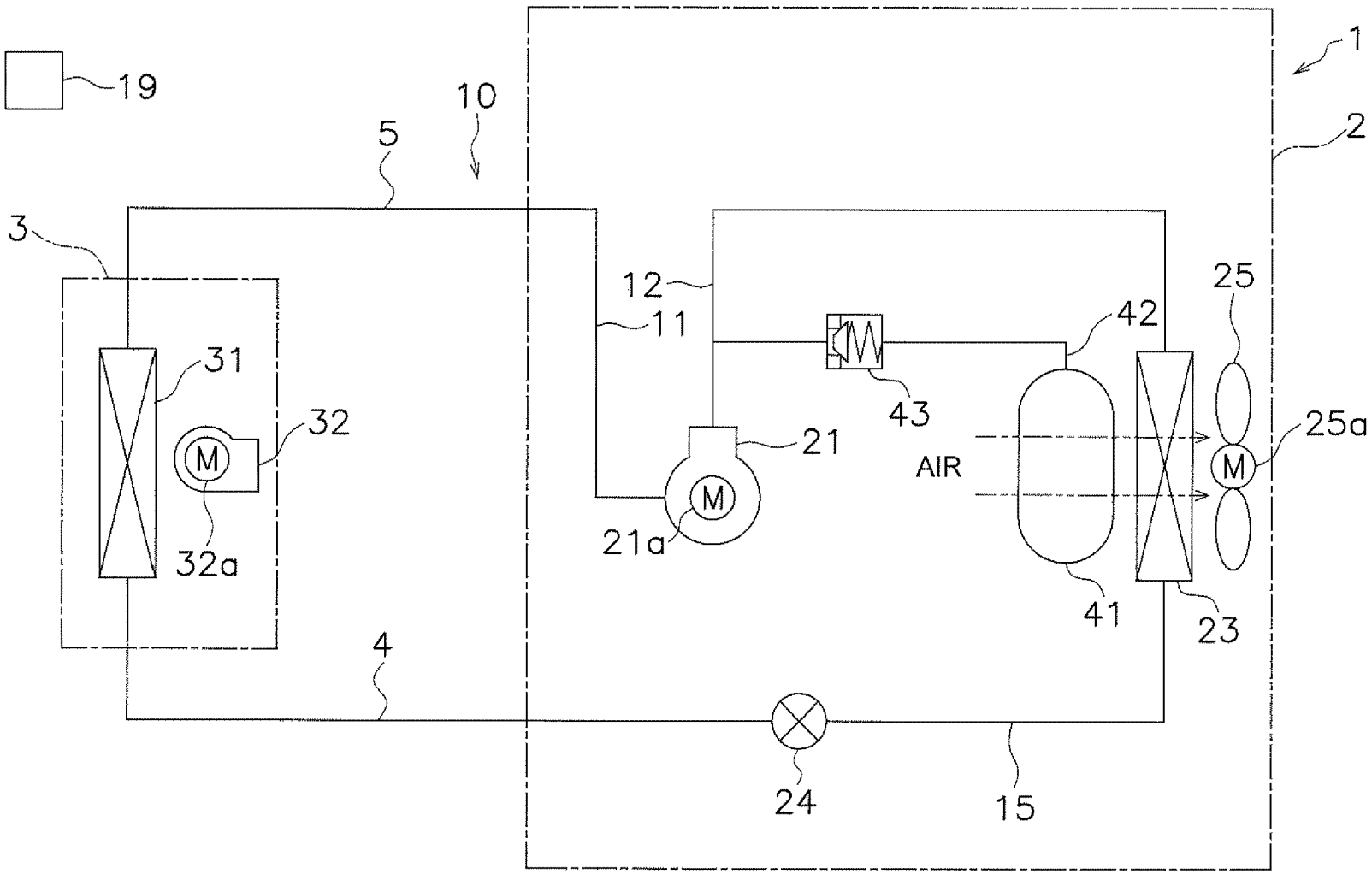
FIG. 17 is a schematic diagram of an air conditioner as one of a refrigeration apparatus according to one or more embodiments.

For example, in one or more embodiments, as illustrated in FIG. 17, the discharged refrigerant recovery receiver 41 may be disposed in a flow path of air delivered to the outdoor heat exchanger 23 by the outdoor fan 25 such that the outdoor fan 25 functions as the cooling mechanism for cooling the discharged refrigerant recovery receiver 41.

In the above case, the outdoor fan 25 for delivering air to the outdoor heat exchanger 23 as the radiator, can also be used as a fan for delivering air to the discharged refrigerant recovery receiver 41. In other words, a dedicated fan for delivering air to the discharged refrigerant recovery receiver 41 can be omitted. The configuration using the fan as the cooling mechanism is preferable when the air conditioner 1 is of the air-cooled type such as illustrated in FIG. 17.

Figure 18:
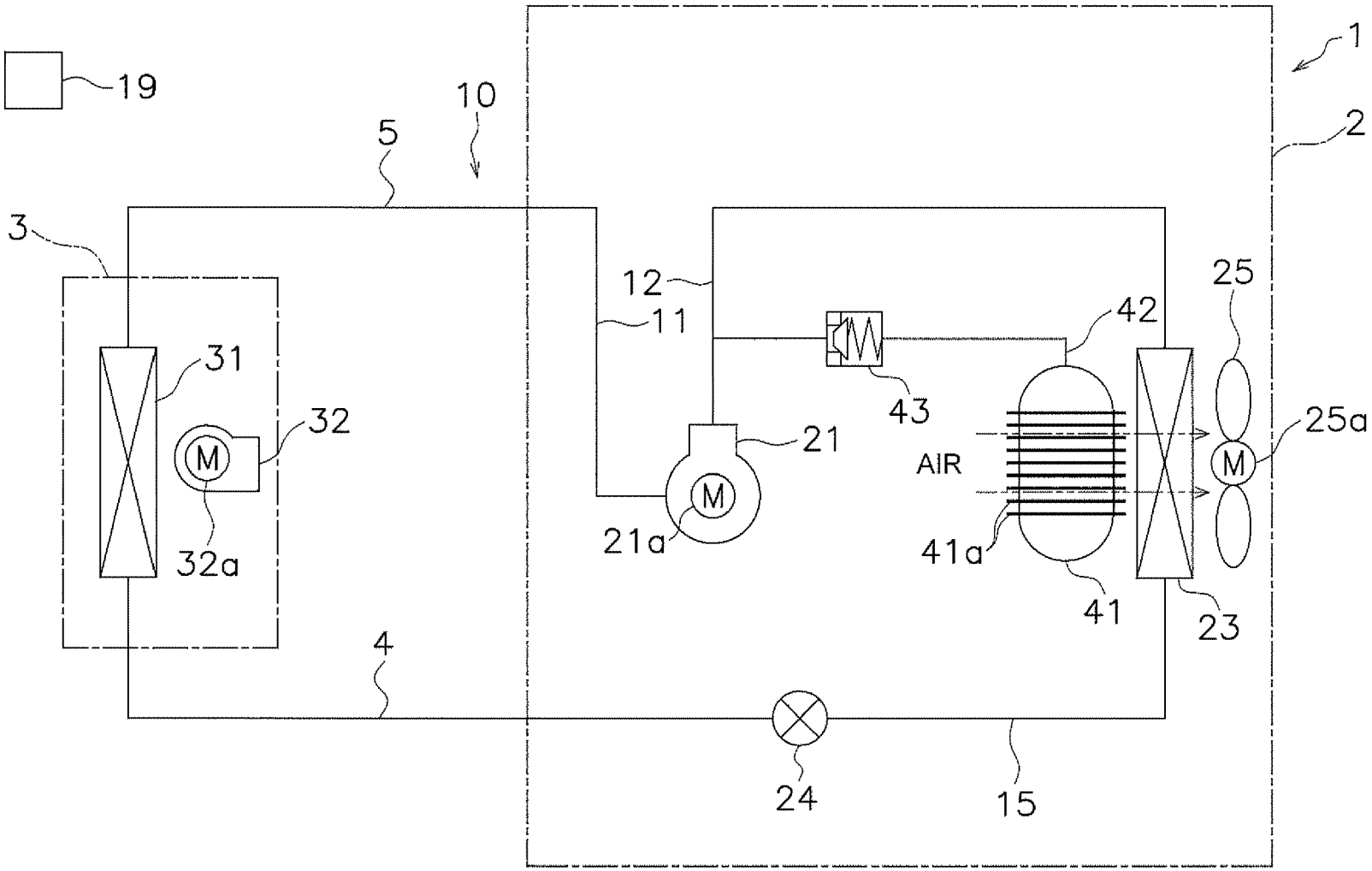
FIG. 18 is a schematic diagram of an air conditioner as one of a refrigeration apparatus according to one or more embodiments.

As illustrated in FIG. 18, for example, in one or more embodiments, a radiating fin 41*a* may be disposed on an outer surface of the discharged refrigerant recovery receiver 41 to function as the cooling mechanism. Such a configuration is preferable when a fan (e.g., the outdoor fan 25) is used as the cooling mechanism in a combined manner.

However, some cooling effect can be obtained with only heat transfer by natural convection through the radiating fin 41*a*, and hence the fan is not always required to be used in combination with the radiating fin.

(12) Modification 9

The cooling mechanism used in Modification 8 is of the type cooling the discharged refrigerant recovery receiver 41 by air, but embodiments of the present invention are not limited to that case. The cooling mechanism may be of the type cooling the discharged refrigerant recovery receiver 41 by a cooling liquid such as water or brine. The following description is made in connection with an example in which the cooling mechanism is disposed in the configuration using the relief valve 43 as the discharged refrigerant relief mechanism, but embodiments of the present invention are not limited to that case. The cooling mechanism may be disposed in the configuration using the fusible plug 44 or the first control valve 45 as the discharged refrigerant relief mechanism.

Figure 19:
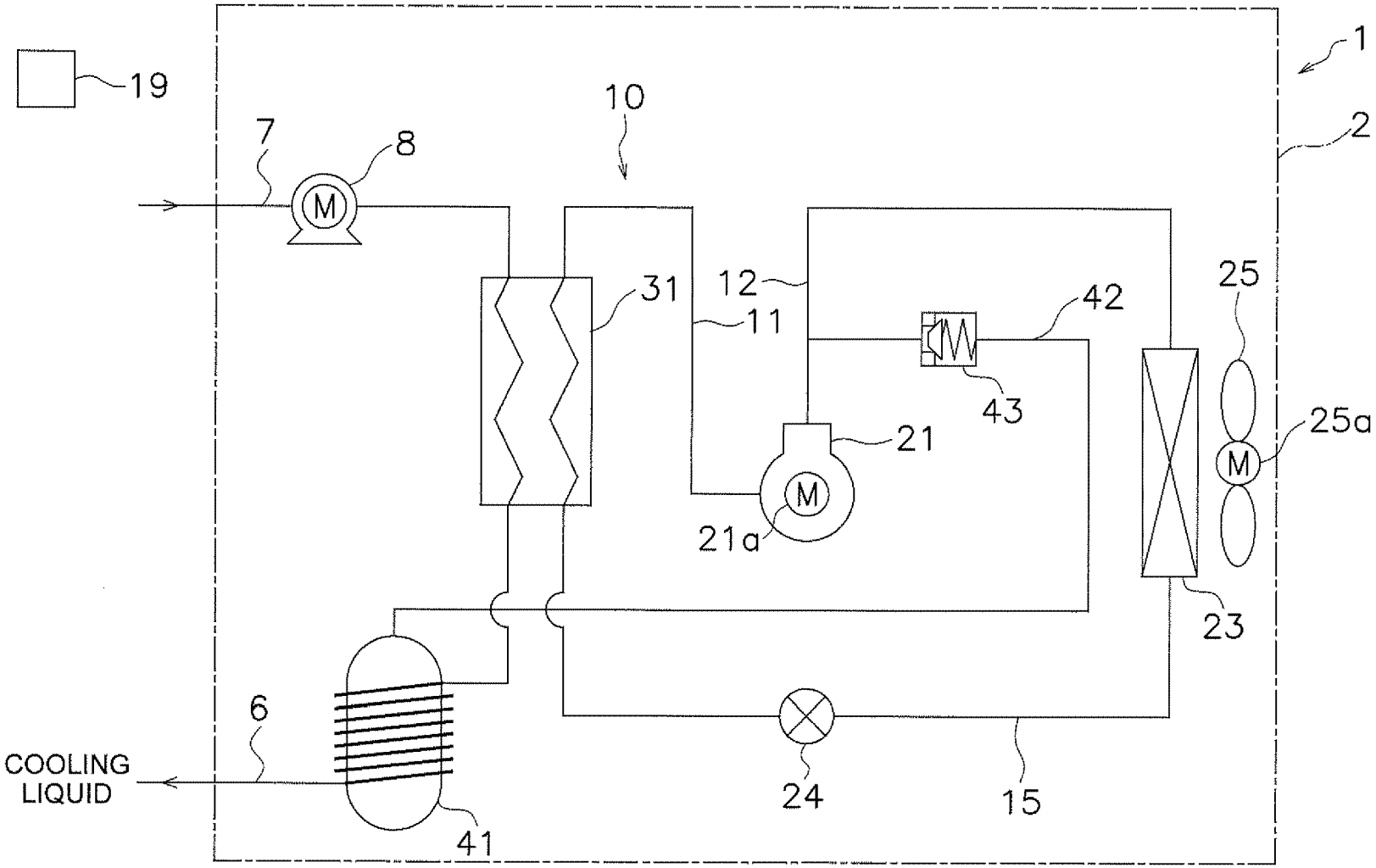
FIG. 19 is a schematic diagram of an air conditioner as one of a refrigeration apparatus according to one or more embodiments.

As illustrated in FIG. 19, for example, in one or more embodiments, the air conditioner 1 may be constituted as a secondary refrigerant type air conditioner including a heat exchanger 31 functioning as a cooling liquid-refrigerant heat exchanger in which the refrigerant is evaporated by heat exchange with a cooling liquid, such as water or brine, flowing through cooling liquid pipes 6 and 7 with the aid of a circulation pump 8, and part of the cooling liquid pipe 6 may be disposed to the discharged refrigerant recovery receiver 41 to function as the cooling mechanism.

In this Modification, the cooling liquid flowing through the cooling liquid pipe 6 can cool the discharged refrigerant recovery receiver 41. Particularly, in this Modification, since the cooling liquid having been cooled by evaporation of the refrigerant in an evaporator flows through the cooling liquid pipe 6, the effect of cooling the discharged refrigerant recovery receiver 41 can be increased. The above configuration using the cooling liquid pipe as the cooling mechanism is preferably applied to the air conditioner 1 of the secondary refrigerant type such as illustrated in FIG. 19.

Also in a water-cooled refrigeration apparatus, though not illustrated herein, the discharged refrigerant recovery receiver 41 can be cooled by arranging a water pipe, which serves as the cooling liquid pipe, to the discharged refrigerant recovery receiver 41.

(13) Modification 10

In the above embodiments and Modifications 1 to 9, application examples of the present invention have been described in connection with the air conditioner 1 dedicated for cooling and processing a cooling load on the indoor side, but air conditioners to which the present invention can be applied are not limited to the cooling-dedicated air conditioner. One or more embodiments of the present invention can be further applied to other types of air conditioners, including a heating-cooling switching air conditioner 1 such as illustrated in FIG. 20, and an indoor multi-type air conditioner (not illustrated) in which a plurality of indoor units 3 are connected.

Figure 20:
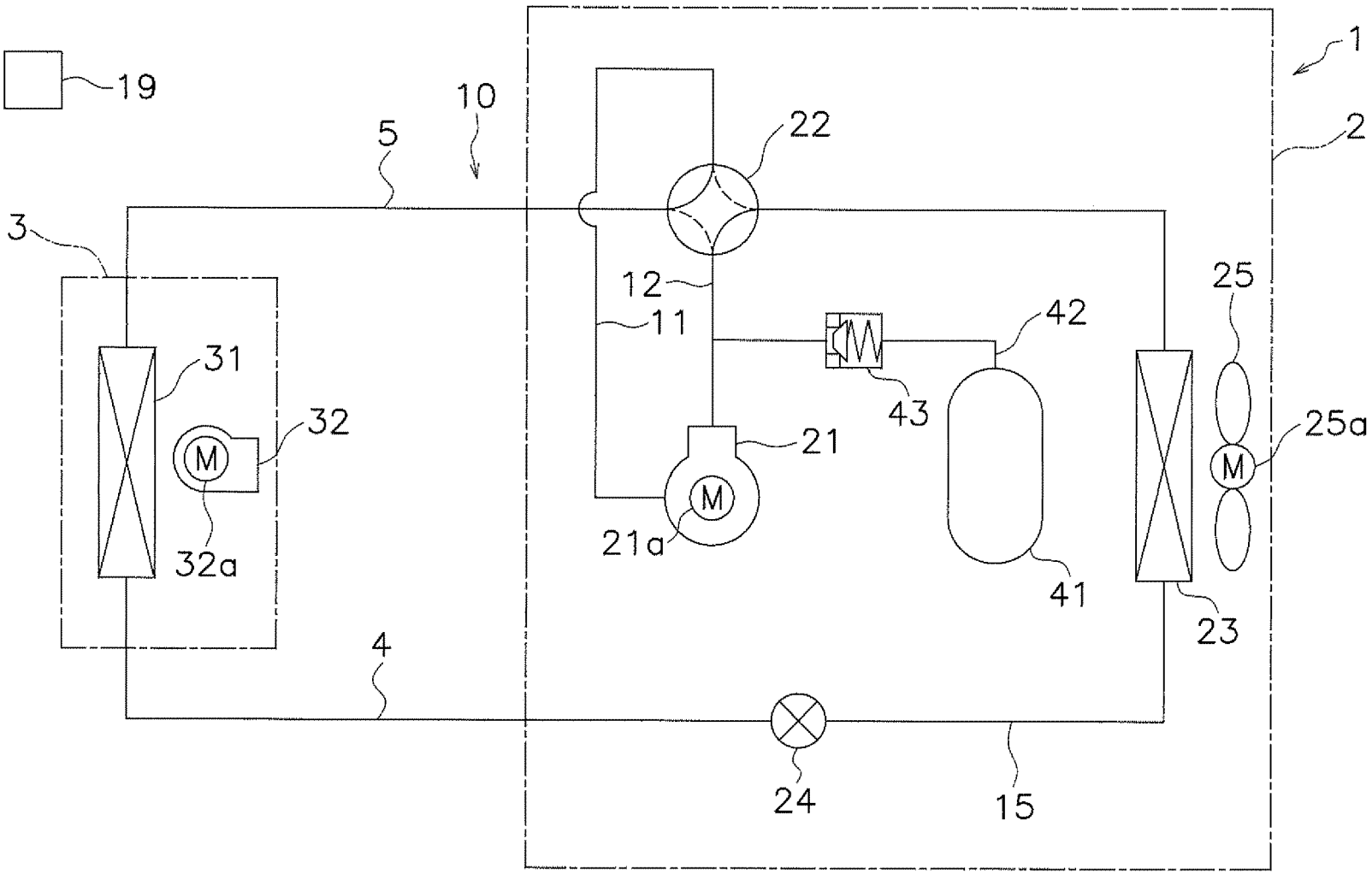
FIG. 20 is a schematic diagram of an air conditioner as one of a refrigeration apparatus according to one or more embodiments.

In the heating-cooling switching air conditioner 1 illustrated in FIG. 20, for example, in one or more embodiments, a four-way switching valve 22 for switching a circulation direction of the refrigerant is disposed in the refrigerant circuit 10. Accordingly, in a cooling operation, the outdoor heat exchanger 23 can be operated to function as the radiator for the refrigerant, and the indoor heat exchanger 31 can be operated to function as the radiator for the refrigerant. Furthermore, in a heating operation, the outdoor heat exchanger 23 can be operated to function as the evaporator for the refrigerant, and the indoor heat exchanger 31 can be operated to function as the radiator for the refrigerant. Thus, in this case, a portion (i.e., the discharge pipe 12) of the refrigerant circuit 10 between the discharge side of the compressor 21 and the four-way switching valve 22 corresponds to a portion between the discharge side of the compressor 21 and the gas side of the radiator (i.e., the outdoor heat exchanger 23 in the cooling operation, the indoor heat exchanger 31 in the heating operation) in each of the cooling operation and the heating operation. Accordingly, similar measures against the disproportionation reaction of the refrigerant to those in the above embodiments and Modifications 1 to 9 can be obtained by branch-connecting the discharged refrigerant recovery receiver 41 to the discharge pipe 12 through the discharged refrigerant relief mechanism 43, 44, or 45.

One or more embodiments of the present invention can be widely applied to refrigeration apparatuses in each of which the refrigerant containing the fluorinated hydrocarbon of nature tending to cause the disproportionation reaction is enclosed in the refrigerant circuit.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

1 air conditioner (refrigeration apparatus)
6 cooling liquid pipe
10 refrigerant circuit
19 control unit
21 compressor
23 outdoor heat exchanger (radiator, evaporator)
24 expansion valve (expansion mechanism)
25 outdoor fan (cooling mechanism)
31 indoor heat exchanger (evaporator, radiator)
42 discharged refrigerant branch pipe
41 discharged refrigerant recovery receiver
41*a* radiating fin
43 relief valve (discharged refrigerant relief mechanism)
44 fusible plug (discharged refrigerant relief mechanism)
45 first control valve (discharged refrigerant relief mechanism)
46 discharged refrigerant sensor
47 discharged refrigerant sensor
48 refrigerant suction return pipe
49 second control valve

The invention claimed is:

1. A refrigeration apparatus comprising:

a refrigerant circuit comprising:

a compressor, a radiator, an expansion mechanism, and an evaporator that are connected, wherein the refrigerant circuit encloses a refrigerant that contains a fluorinated hydrocarbon that causes a disproportionation reaction;

a discharged refrigerant recovery receiver that is branch-connected to a path between a discharge side of the compressor and a gas side of the radiator through a discharged refrigerant branch pipe;

a first control valve that is disposed in the discharged refrigerant branch pipe and that connects the discharge side of the compressor with the discharged refrigerant recovery receiver when in an open state, a discharged refrigerant sensor that detects pressure and temperature of the refrigerant on the discharge side of the compressor;

a refrigerant suction return pipe that connects the discharged refrigerant recovery receiver and a suction side of the compressor; and a second control valve disposed in the refrigerant suction return pipe and that connects the discharged refrigerant recovery receiver with the suction side of the compressor when in an open state, wherein the refrigeration apparatus further comprises a controller that controls operation of the first control valve, the second control valve, and the compressor, the controller monitors whether a predetermined operation state exists, the predetermined operation state includes a first condition under which the refrigerant does not cause the disproportionation reaction and a second condition under which the refrigerant causes the disproportionation reaction, where the second condition includes at least one of:

a condition under which a pressure and a temperature of the refrigerant at a discharge side of the compressor reach a curve indicating boundaries of the pressure and the temperature at which the refrigerant causes the disproportionation reaction;

a condition under which the pressure of the refrigerant at the discharge side of the compressor becomes a lower limit value of the pressure at which the refrigerant causes the disproportionation reaction at a maximum operating temperature of the refrigerant circuit; and a condition under which the temperature of the refrigerant at the discharge side of the compressor becomes a lower limit value of the temperature at which the refrigerant causes the disproportionation reaction at a maximum operating pressure of the refrigerant circuit, the controller determines, based on the pressure and temperature of the refrigerant detected by the discharged refrigerant sensor, whether the first condition or the second condition is satisfied, and controls the first control valve to be in the open state when the first condition or the second condition is satisfied, and in a case where the controller determines that the first condition is satisfied and the second condition is not satisfied, the controller controls the first control valve to be in the open state and the second control valve to be in the open state while continuing the operation of the refrigeration apparatus by continuing the operation of the compressor.

2. The refrigeration apparatus according to claim 1, further comprising a cooling mechanism that cools the discharged refrigerant recovery receiver.

3. The refrigeration apparatus according to claim 2, wherein the cooling mechanism is a fan that delivers air to the discharged refrigerant recovery receiver.

4. The refrigeration apparatus according to claim 3, wherein the fan further delivers the air to the radiator or the evaporator.

5. The refrigeration apparatus according to claim 2, wherein the cooling mechanism is a radiating fin that is disposed on an outer surface of the discharged refrigerant recovery receiver.

6. The refrigeration apparatus according to claim 2, wherein the cooling mechanism is a cooling liquid pipe that is disposed on the discharged refrigerant recovery receiver, and a cooling liquid flows through the cooling liquid pipe.

7. The refrigeration apparatus according to claim 6, wherein the evaporator is a heat exchanger in which the refrigerant is evaporated using the cooling liquid, and the cooling liquid in the evaporator that is cooled by evaporation of the refrigerant flows through the cooling liquid pipe.

8. The refrigeration apparatus according to claim 1, wherein the controller determines, based on the detected pressure and temperature of the refrigerant, whether the second condition is satisfied, and when the second condition is satisfied:

controls the first control valve to be in the open state and the second control valve to be in a closed state, and stops operation of the compressor.

9. The refrigeration apparatus according claim 1, wherein the refrigerant contains HFO-1123.

* * * * *